US007972214B2

(12) United States Patent
Kinsley et al.

(10) Patent No.: US 7,972,214 B2
(45) Date of Patent: Jul. 5, 2011

(54) METHODS AND DEVICES FOR DOWNLOADING GAMES OF CHANCE

(75) Inventors: Michael Kinsley, Reno, NV (US); Binh T. Nguyen, Reno, NV (US); Jamal Benbrahim, Reno, NV (US)

(73) Assignee: IGT, Reno, NV (US)

( * ) Notice: Subject to any disclaimer, the term of this patent is extended or adjusted under 35 U.S.C. 154(b) by 767 days.

(21) Appl. No.: 11/173,442

(22) Filed: Jul. 1, 2005

(65) Prior Publication Data

US 2007/0004506 A1 Jan. 4, 2007

Related U.S. Application Data

(63) Continuation-in-part of application No. 11/078,966, filed on Mar. 10, 2005, now Pat. No. 7,515,718, and a continuation-in-part of application No. 10/116,424, filed on Apr. 3, 2002, now Pat. No. 7,168,089, and a continuation-in-part of application No. 09/732,650, filed on Dec. 7, 2000, now Pat. No. 7,127,069.

(51) Int. Cl.
*A63F 9/00* (2006.01)

(52) U.S. Cl. ..... 463/42; 713/100; 713/155

(58) Field of Classification Search ..... 463/42; 713/100, 175; 717/173; 709/222; 386/230
See application file for complete search history.

(56) References Cited

U.S. PATENT DOCUMENTS

| | | | |
|---|---|---|---|
| 3,931,504 | A | 1/1976 | Jacoby |
| 4,335,809 | A | 6/1982 | Wain |
| 4,430,728 | A | 2/1984 | Beitel et al. |
| 4,454,594 | A | 6/1984 | Heffron et al. |
| 4,468,750 | A | 8/1984 | Chamoff et al. |
| 4,532,416 | A | 7/1985 | Berstein |
| 4,572,509 | A | 2/1986 | Sitrick |
| 4,607,844 | A | 8/1986 | Fullerton |
| 4,652,998 | A | 3/1987 | Koza et al. |

(Continued)

FOREIGN PATENT DOCUMENTS

AU 199650576 4/1997

(Continued)

OTHER PUBLICATIONS

International Search Report, mailed Oct. 11, 2006 from corresponding International Application No. PCT/US2006/024129, 6 pp. including Notification of Transmittal.

(Continued)

*Primary Examiner* — Masud Ahmed
(74) *Attorney, Agent, or Firm* — Weaver Austin Villeneuve & Sampson LLP

(57) ABSTRACT

The present invention provides methods, devices and systems for downloading gaming software. According to some implementations of the invention, gaming software is continuously transmitted on a plurality of channels, e.g., by one or more servers. In some such implementations, each channel is dedicated to software for a different wagering game. In other implementations, gaming software components are transmitted on a plurality of channels, with each channel dedicated to a particular gaming software component. Some implementations provide gaming software in response to a request from a gaming machine. Implementations over dedicated and/or public networks are provided. Preferred implementations of the invention allow gaming software to be downloaded to gaming machines in a secure manner that automatically ensures that licensing and regulatory requirements are satisfied. Some such implementations determine whether payment is required for gaming software and provide for automated payment, if so required.

24 Claims, 9 Drawing Sheets

U.S. PATENT DOCUMENTS 4,689,742 A 8/1987 Troy et al.
4,856,787 A 8/1989 Itkis
4,868,900 A 9/1989 McGuire
5,103,079 A 4/1992 Barakai et al.
5,136,644 A 8/1992 Audebert et al.
5,149,945 A 9/1992 Johnson et al.
5,155,837 A 10/1992 Liu et al.
5,265,874 A 11/1993 Dickinson et al.
5,286,062 A 2/1994 Greenwood et al.
5,290,033 A 3/1994 Bittner et al.
5,342,047 A 8/1994 Heidel et al.
5,348,299 A 9/1994 Clapper, Jr.
5,397,125 A 3/1995 Adams
5,410,703 A 4/1995 Nilsson et al.
5,421,009 A 5/1995 Platt
5,421,017 A 5/1995 Scholz et al.
5,466,920 A 11/1995 Nair et al.
5,473,772 A 12/1995 Halliwell et al.
5,487,544 A 1/1996 Clapper, Jr.
5,489,096 A 2/1996 Aron
5,491,812 A 2/1996 Pisello et al.
5,555,418 A 9/1996 Nilsson et al.
5,609,337 A 3/1997 Clapper, Jr.
5,611,730 A 3/1997 Weiss
5,643,086 A * 7/1997 Alcorn et al. ..... 463/29
5,645,485 A 7/1997 Clapper, Jr.
5,647,592 A 7/1997 Gerow
5,654,746 A 8/1997 McMullan, Jr. et al.
5,655,961 A 8/1997 Acres et al.
5,671,412 A 9/1997 Christiano
5,682,533 A 10/1997 Siljestroemer
5,684,750 A 11/1997 Charnoff et al.
5,688,174 A 11/1997 Kennedy
5,702,304 A 12/1997 Acres et al.
5,715,403 A 2/1998 Stefik
5,715,462 A 2/1998 Iwamoto et al.
5,741,183 A 4/1998 Acres et al.
5,749,784 A 5/1998 Clapper, Jr.
5,752,882 A 5/1998 Acres et al.
5,759,102 A 6/1998 Pease et al.
5,761,647 A 6/1998 Boushy
5,762,552 A 6/1998 Vuong et al.
5,766,076 A 6/1998 Pease et al.
5,768,382 A 6/1998 Schneier et al.
5,770,533 A 6/1998 Franchi
5,779,545 A 7/1998 Berg et al.
5,779,549 A 7/1998 Walker et al.
5,797,795 A 8/1998 Takemoto et al.
5,800,269 A 9/1998 Holch et al.
5,819,107 A 10/1998 Lichtman et al.
5,820,459 A 10/1998 Acres et al.
5,828,843 A 10/1998 Grimm et al.
5,833,540 A 11/1998 Miodunski et al.
5,836,817 A 11/1998 Acres et al.
5,845,077 A 12/1998 Fawcett
5,845,090 A 12/1998 Collins et al.
5,845,902 A 12/1998 Takemoto
5,848,064 A 12/1998 Cowan
5,851,149 A 12/1998 Xidos et al.
5,855,515 A 1/1999 Pease et al.
5,870,723 A 2/1999 Pare, Jr. et al.
5,871,400 A 2/1999 Yfantis
5,876,284 A 3/1999 Acres et al.
5,885,158 A 3/1999 Torango et al.
5,896,566 A 4/1999 Averbuch et al.
5,902,983 A 5/1999 Crevelt et al.
5,905,523 A 5/1999 Woodfield et al.
5,925,127 A * 7/1999 Ahmad ..... 726/31
5,935,000 A 8/1999 Sanchez, III et al.
5,941,771 A 8/1999 Haste, III
5,943,241 A 8/1999 Nichols et al.
5,949,042 A 9/1999 Dietz, II et al.
5,970,143 A 10/1999 Schneier et al.
5,971,855 A 10/1999 Ng
5,980,384 A 11/1999 Barrie
5,980,385 A 11/1999 Clapper, Jr.
5,987,376 A 11/1999 Olson et al.
5,999,808 A 12/1999 LaDue
6,001,016 A 12/1999 Walker et al.
6,002,772 A 12/1999 Saito
6,003,013 A 12/1999 Boushy et al.
6,006,034 A 12/1999 Heath et al.
6,009,458 A 12/1999 Hawkins et al.
6,029,046 A 2/2000 Khan et al.
6,038,666 A 3/2000 Hsu et al.
6,047,128 A 4/2000 Zander
6,047,324 A 4/2000 Ford
6,048,269 A 4/2000 Burns et al.
6,052,512 A 4/2000 Peterson et al.
6,071,190 A * 6/2000 Weiss et al. ..... 463/25
6,098,837 A 8/2000 Izawa et al.
6,099,408 A 8/2000 Schneier et al.
6,104,815 A 8/2000 Alcorn et al.
6,106,396 A * 8/2000 Alcorn et al. ..... 463/29
6,113,098 A 9/2000 Adams
6,113,492 A 9/2000 Walker et al.
6,113,495 A 9/2000 Walker et al.
6,125,185 A 9/2000 Boesch
6,135,884 A 10/2000 Hedrick et al.
6,135,887 A 10/2000 Pease et al.
6,146,277 A 11/2000 Ikeda
6,149,522 A 11/2000 Alcorn et al.
6,154,878 A 11/2000 Saboff
6,159,098 A 12/2000 Stomiany et al.
6,165,072 A 12/2000 Davis et al.
6,169,976 B1 1/2001 Colosso
6,178,510 B1 1/2001 O'Connor et al.
6,183,362 B1 2/2001 Boushy
6,190,256 B1 2/2001 Walker et al.
6,193,152 B1 2/2001 Fernando et al.
6,193,608 B1 2/2001 Walker et al.
6,199,107 B1 3/2001 Dujari
6,219,836 B1 4/2001 Wells et al.
6,253,374 B1 6/2001 Dresevic et al.
6,254,483 B1 7/2001 Acres
6,264,561 B1 7/2001 Saffari et al.
6,270,410 B1 8/2001 DeMar et al.
6,280,328 B1 8/2001 Holch et al.
6,285,868 B1 9/2001 LaDue
6,285,886 B1 * 9/2001 Kamel et al. ..... 455/522
6,293,865 B1 9/2001 Kelly et al.
6,302,793 B1 10/2001 Fertitta, III et al.
6,306,035 B1 10/2001 Kelly et al.
6,310,873 B1 10/2001 Rainis et al.
6,315,663 B1 11/2001 Sakamoto
6,317,827 B1 11/2001 Cooper
6,328,648 B1 12/2001 Walker et al.
6,340,331 B1 1/2002 Saunders et al.
6,343,990 B1 2/2002 Rasmussen et al.
6,347,996 B1 2/2002 Gilmore et al.
6,351,688 B1 2/2002 Nichols et al.
6,364,769 B1 4/2002 Weiss et al.
6,368,216 B1 4/2002 Hedrick et al.
6,368,219 B1 4/2002 Szrek et al.
6,371,852 B1 4/2002 Acres
6,402,618 B1 6/2002 Reed et al.
6,409,602 B1 6/2002 Wiltshire et al.
6,446,257 B1 9/2002 Pradhan et al.
6,449,687 B1 9/2002 Moriya
6,453,319 B1 9/2002 Mattis et al.
6,454,648 B1 9/2002 Kelly et al.
6,488,585 B1 12/2002 Wells et al.
6,508,709 B1 1/2003 Karmarkar
6,508,710 B1 1/2003 Paravia et al.
6,554,705 B1 4/2003 Cumbers
6,575,829 B2 6/2003 Coleman et al.
6,607,439 B2 8/2003 Schneier et al.
6,638,170 B1 10/2003 Crumby
6,645,077 B2 11/2003 Rowe
6,645,078 B1 11/2003 Mattice
6,652,378 B2 11/2003 Cannon et al.
6,656,040 B1 12/2003 Brosnan et al.
6,666,765 B2 12/2003 Vancura
6,682,423 B2 1/2004 Brosnan et al.
6,684,195 B1 1/2004 Deaton et al.
6,739,973 B1 5/2004 Lucchesi et al.
6,745,236 B1 6/2004 Hawkins et al.

| | | | | |
|---|---|---|---|---|
| 6,749,502 | B2 | 6/2004 | Baerlocher | |
| 6,749,510 | B2 | 6/2004 | Giobbi | |
| 6,785,291 | B1 | 8/2004 | Cao et al. | |
| 6,805,634 | B1 * | 10/2004 | Wells et al. | 463/42 |
| 6,853,973 | B2 | 2/2005 | Mathews et al. | |
| 6,866,586 | B2 | 3/2005 | Oberberger et al. | |
| 6,875,110 | B1 | 4/2005 | Crumby | |
| 6,896,618 | B2 | 5/2005 | Benoy et al. | |
| 6,908,387 | B2 | 6/2005 | Hedrick et al. | |
| 6,910,079 | B2 * | 6/2005 | Zimmermann et al. | 709/233 |
| 6,913,531 | B1 | 7/2005 | Yoseloff | |
| 6,935,946 | B2 | 8/2005 | Yoseloff et al. | |
| 6,962,530 | B2 | 11/2005 | Jackson | |
| 6,988,267 | B2 | 1/2006 | Harris et al. | |
| 6,997,803 | B2 | 2/2006 | LeMay et al. | |
| 7,127,069 | B2 | 10/2006 | Nguyen | |
| 7,168,089 | B2 * | 1/2007 | Nguyen et al. | 726/4 |
| 7,318,775 | B2 | 1/2008 | Brosnan et al. | |
| 7,399,229 | B2 | 7/2008 | Rowe | |
| 7,438,643 | B2 | 10/2008 | Brosnan et al. | |
| 7,455,591 | B2 | 11/2008 | Nguyen | |
| 7,470,182 | B2 | 12/2008 | Martinek et al. | |
| 7,480,857 | B2 | 1/2009 | Benbrahim et al. | |
| 7,515,718 | B2 | 4/2009 | Nguyen et al. | |
| 7,618,317 | B2 | 11/2009 | Jackson | |
| 7,636,859 | B2 | 12/2009 | Little et al. | |
| 7,780,526 | B2 | 8/2010 | Nguyen et al. | |
| 7,785,204 | B2 | 8/2010 | Wells et al. | |
| 7,801,303 | B2 | 9/2010 | Dulac | |
| 7,828,654 | B2 | 11/2010 | Carter, Sr. | |
| 7,887,420 | B2 | 2/2011 | Nguyen et al. | |
| 2001/0021666 | A1 | 9/2001 | Yoshida et al. | |
| 2001/0031663 | A1 | 10/2001 | Johnson | |
| 2001/0036854 | A1 | 11/2001 | Okuniewicz | |
| 2001/0036855 | A1 | 11/2001 | DeFrees-Parrott et al. | |
| 2001/0039210 | A1 | 11/2001 | St-Denis | |
| 2001/0044337 | A1 | 11/2001 | Rowe et al. | |
| 2001/0044339 | A1 | 11/2001 | Cordero et al. | |
| 2001/0053712 | A1 | 12/2001 | Yoseloff et al. | |
| 2002/0002075 | A1 | 1/2002 | Rowe | |
| 2002/0016202 | A1 | 2/2002 | Fertitta et al. | |
| 2002/0022516 | A1 | 2/2002 | Forden | |
| 2002/0034980 | A1 * | 3/2002 | Lemmons et al. | 463/40 |
| 2002/0045477 | A1 | 4/2002 | Dabrowski | |
| 2002/0049909 | A1 | 4/2002 | Jackson et al. | |
| 2002/0050683 | A1 | 5/2002 | Hirota | |
| 2002/0071557 | A1 | 6/2002 | Nguyen | |
| 2002/0093136 | A1 | 7/2002 | Moody | |
| 2002/0107065 | A1 | 8/2002 | Rowe | |
| 2002/0111205 | A1 | 8/2002 | Beavers | |
| 2002/0116615 | A1 * | 8/2002 | Nguyen et al. | 713/168 |
| 2002/0132662 | A1 | 9/2002 | Sharp et al. | |
| 2002/0137217 | A1 | 9/2002 | Rowe | |
| 2002/0142844 | A1 | 10/2002 | Kerr | |
| 2002/0151359 | A1 | 10/2002 | Rowe | |
| 2002/0155887 | A1 | 10/2002 | Criss-Puszkiewicz et al. | |
| 2003/0009542 | A1 * | 1/2003 | Kasal et al. | 709/222 |
| 2003/0032485 | A1 | 2/2003 | Cockerille et al. | |
| 2003/0036425 | A1 | 2/2003 | Kaminkow et al. | |
| 2003/0045356 | A1 | 3/2003 | Thomas | |
| 2003/0064771 | A1 | 4/2003 | Morrow et al. | |
| 2003/0064805 | A1 | 4/2003 | Wells | |
| 2003/0069074 | A1 | 4/2003 | Jackson | |
| 2003/0095791 | A1 * | 5/2003 | Barton et al. | 386/83 |
| 2003/0100371 | A1 | 5/2003 | Gatto et al. | |
| 2003/0157979 | A1 | 8/2003 | Cannon et al. | |
| 2003/0186734 | A1 | 10/2003 | LeMay et al. | |
| 2003/0187853 | A1 * | 10/2003 | Hensley et al. | 707/10 |
| 2003/0188306 | A1 | 10/2003 | Harris et al. | |
| 2004/0002385 | A1 | 1/2004 | Nguyen | |
| 2004/0048671 | A1 | 3/2004 | Rowe | |
| 2004/0067794 | A1 | 4/2004 | Coetzee | |
| 2004/0092310 | A1 | 5/2004 | Brosnan et al. | |
| 2004/0137978 | A1 | 7/2004 | Cole et al. | |
| 2004/0147314 | A1 | 7/2004 | LeMay et al. | |
| 2004/0152517 | A1 | 8/2004 | Hardisty et al. | |
| 2004/0166931 | A1 | 8/2004 | Criss-Puszkiewicz et al. | |
| 2004/0180722 | A1 | 9/2004 | Giobbi | |
| 2004/0242322 | A1 | 12/2004 | Montagna et al. | |
| 2004/0248651 | A1 | 12/2004 | Gagner | |
| 2004/0259640 | A1 | 12/2004 | Gentles et al. | |
| 2005/0059470 | A1 | 3/2005 | Cannon | |
| 2005/0108519 | A1 * | 5/2005 | Barton et al. | 713/155 |
| 2005/0108769 | A1 * | 5/2005 | Arnold et al. | 725/115 |
| 2005/0113172 | A1 | 5/2005 | Gong | |
| 2005/0120040 | A1 * | 6/2005 | Williams et al. | 707/102 |
| 2005/0137016 | A1 | 6/2005 | Enzminger et al. | |
| 2005/0153778 | A1 | 7/2005 | Nelson et al. | |
| 2005/0192099 | A1 | 9/2005 | Nguyen et al. | |
| 2005/0216942 | A1 * | 9/2005 | Barton | 725/97 |
| 2005/0221898 | A1 | 10/2005 | Gatto et al. | |
| 2005/0288080 | A1 | 12/2005 | Lockton et al. | |
| 2006/0009273 | A2 | 1/2006 | Moshal | |
| 2006/0019749 | A1 | 1/2006 | Merati et al. | |
| 2006/0035713 | A1 | 2/2006 | Cockerille et al. | |
| 2006/0046855 | A1 | 3/2006 | Nguyen et al. | |
| 2006/0068871 | A1 | 3/2006 | Crawford et al. | |
| 2006/0073869 | A1 | 4/2006 | LeMay et al. | |
| 2006/0160621 | A1 | 7/2006 | Rowe et al. | |
| 2006/0247028 | A1 | 11/2006 | Brosnan et al. | |
| 2006/0258428 | A1 * | 11/2006 | Blackburn et al. | 463/16 |
| 2006/0264256 | A1 | 11/2006 | Gagner et al. | |
| 2006/0281541 | A1 | 12/2006 | Nguyen et al. | |
| 2007/0026935 | A1 | 2/2007 | Wolf et al. | |
| 2007/0032301 | A1 | 2/2007 | Acres et al. | |
| 2007/0060361 | A1 | 3/2007 | Nguyen et al. | |
| 2007/0060363 | A1 | 3/2007 | Nguyen et al. | |
| 2007/0178970 | A1 | 8/2007 | LeMay et al. | |
| 2007/0207852 | A1 | 9/2007 | Nelson et al. | |
| 2007/0270213 | A1 | 11/2007 | Nguyen et al. | |
| 2008/0090654 | A1 | 4/2008 | Okada | |
| 2008/0192058 | A1 | 8/2008 | Liu et al. | |
| 2009/0209332 | A1 | 8/2009 | Soukup et al. | |
| 2010/0099491 | A1 | 4/2010 | Little et al. | |

FOREIGN PATENT DOCUMENTS

| | | | |
|---|---|---|---|
| DE | 197 30 002 | A1 | 12/1997 |
| EP | 0 689 325 | | 6/1995 |
| EP | 0 706 275 | | 4/1996 |
| EP | 0715245 | A1 | 6/1996 |
| EP | 0744786 | | 11/1996 |
| EP | 0841 615 | | 5/1998 |
| EP | 0 905 614 | | 3/1999 |
| EP | 1 004 970 | | 5/2000 |
| EP | 1061430 | A1 | 12/2000 |
| EP | 1074955 | A2 | 2/2001 |
| EP | 1 199 690 | | 4/2002 |
| EP | 1 231 577 | | 8/2002 |
| EP | 1 255 234 | | 11/2002 |
| EP | 1 291 048 | | 3/2003 |
| EP | 1 396 829 | | 3/2004 |
| EP | 1 414 534 | | 5/2004 |
| EP | 1 473 682 | | 11/2004 |
| EP | 1 895 483 | | 3/2008 |
| GB | 2 151 054 | | 7/1985 |
| GB | 2 251 112 | | 6/1992 |
| GB | 2 392 276 | | 10/2004 |
| RU | 2124230 | | 12/1998 |
| RU | 17678 | U1 | 4/2001 |
| WO | WO 95/24689 | | 9/1995 |
| WO | WO 96/00950 | | 1/1996 |
| WO | WO 97/30549 | | 8/1997 |
| WO | WO 99/00164 | | 1/1999 |
| WO | WO 99/01188 | | 1/1999 |
| WO | WO 00/67424 | | 11/2000 |
| WO | WO 01/20424 | | 3/2001 |
| WO | WO 01/99067 | | 12/2001 |
| WO | WO 01/99067 | A2 | 12/2001 |
| WO | 02/05229 | A2 | 1/2002 |
| WO | 02/05229 | A3 | 1/2002 |
| WO | WO 02/05229 | | 1/2002 |
| WO | WO 02/17251 | | 2/2002 |
| WO | WO 02/21468 | | 3/2002 |
| WO | WO 02/073501 | | 9/2002 |
| WO | WO 02/077935 | | 10/2002 |
| WO | WO 03/006129 | | 1/2003 |
| WO | WO 03/019486 | | 3/2003 |
| WO | WO 03/085613 | A1 | 10/2003 |

| | | |
|---|---|---|
| WO | WO 2004/021290 | 3/2004 |
| WO | 2007/005290 | 1/2007 |
| WO | WO 2007/005290 | 1/2007 |
| WO | WO 2007/032879 | 3/2007 |
| WO | WO 2007/032888 | 3/2007 |
| WO | WO 2007/044175 | 4/2007 |
| WO | WO 2007/120450 | 10/2007 |
| WO | WO 2008/016610 | 2/2008 |
| WO | WO 2010/045004 | 4/2010 |

OTHER PUBLICATIONS

Written Opinion of the International Searching Authority, mailed Oct. 11, 2006 from corresponding International Application No. PCT/US2006/024129, 6 pp.
EPO Communication dated Apr. 14, 2008 for EP Application No. 06 773 680.1-2221 (5 pages).
Webster's 1913 Dictionary, Definition of 'Regular' by Webster's Online Dictionary, http://www.webster-dictionary.org/definition/regular, printed Mar. 2, 2009, 3 pages.
Webster's 1913 Dictionary , Definition of 'Continuous' by Webster's Online Dictionary, http://www.webster-dictionary.org/definition/continuous, printed Mar. 2, 2009, 2 pages.
Summons to Attend Oral Proceedings dated Nov. 27, 2008 from European Application No. 06773680.1-2221.
Result of Consultation dated Sep. 24, 2009 from European Application No. 06773680.1-2221.
Provision of the Minutes of the Oral Proceedings dated Jan. 8, 2010 from European Application No. 06773680.1-2221.
Decision to Refuse a European Patent Application dated Jan. 8, 2010 from European Application No. 06773680.1-2221.
U.S. Appl. No. 09/595,798, filed Jun. 16, 2000, Brosnan, Wiiliam R.
U.S. Appl. No. 09/642,192, filed Aug. 18, 2000, LeMay et al.
U.S. Office Action mailed Jul. 15, 2002 issued in U.S. Appl. No. 09/595,798.
U.S. Final Office Action mailed Mar. 20, 2003 issued in U.S. Appl. No. 09/595,798.
U.S. Advisory Action mailed May 21, 2003 issued in U.S. Appl. No. 09/595,798.
U.S. Office Action mailed Jul. 1, 2003 issued in U.S. Appl. No. 09/595,798.
U.S. Office Action mailed Jan. 14, 2004 issued in U.S. Appl. No. 09/595,798.
U.S. Interview Summary mailed Mar. 9, 2004 issued in U.S. Appl. No. 09/595,798.
U.S. Final Office Action mailed Jun. 3, 2004 issued in U.S. Appl. No. 09/595,798.
U.S. Office Action mailed Jan. 28, 2005 issued in U.S. Appl. No. 09/595,798.
U.S. Final Office Action mailed May 3, 2006 issued in U.S. Appl. No. 09/595,798.
U.S. Office Action mailed Sep. 6, 2006 issued in U.S. Appl. No. 09/595,798.
U.S. Final Office Action mailed Mar. 14, 2007 issued in U.S. Appl. No. 09/595,798.
U.S. Decision Pre-Appeal mailed Sep. 14, 2007 issued in U.S. Appl. No. 09/595,798.
U.S. Notice of Abandonment mailed Mar. 5, 2008 issued in U.S. Appl. No. 09/595,798.
U.S. Notice of Petition Granted re Notice of Abandonment Vacated mailed Jun. 24, 2009 issued in U.S. Appl. No. 09/595,798.
U.S. Office Action mailed Sep. 16, 2009 issued in U.S. Appl. No. 09/595,798.
U.S. Interview Summary mailed Jan. 13, 2010 issued in U.S. Appl. No. 09/595,798.
U.S. Notice of Allowance and Allowability mailed May 14, 2010 issued in U.S. Appl. No. 09/595,798.
U.S. Notice of Allowance and Allowability mailed Sep. 20, 2010 issued in U.S. Appl. No. 09/595,798.
U.S. Notice of Allowance mailed Jan. 7, 2011 issued in U.S. Appl. No. 09/595,798.
U.S. Office Action mailed Jul. 1, 2002 issued in U.S. Appl. No. 09/642,192.
U.S. Interview Summary mailed Oct. 9, 2002 issued in U.S. Appl. No. 09/642,192.
U.S. Final Office Action mailed Jan. 2, 2003 issued in U.S. Appl. No. 09/642,192.
U.S. Interview Summary mailed Jan. 14, 2003 issued in U.S. Appl. No. 09/642,192.
U.S. Advisory Action mailed Jan. 29, 2003 issued in U.S. Appl. No. 09/642,192.
U.S. Office Action mailed Apr. 21, 2003 issued in U.S. Appl. No. 09/642,192.
U.S. Final Office Action mailed Sep. 30, 2003 issued in U.S. Appl. No. 09/642,192.
U.S. Interview Summary mailed Oct. 22, 2003 issued in U.S. Appl. No. 09/642,192.
U.S. Advisory Action mailed Nov. 6, 2003 issued in U.S. Appl. No. 09/642,192.
U.S. Office Action mailed Feb. 10, 2004 issued in U.S. Appl. No. 09/642,192.
U.S. Office Action mailed Jul. 1, 2004 issued in U.S. Appl. No. 09/642,192.
U.S. Interview Summary mailed Mar. 14, 2004 issued in U.S. Appl. No. 09/642,192.
U.S. Notice of Informal or Non-Responsive RCE Amendment mailed Jan. 11, 2006 issued in U.S. Appl. No. 09/642,192.
U.S. Final Office Action mailed Mar. 28, 2006 issued in U.S. Appl. No. 09/642,192.
U.S. Office Action mailed Nov. 20, 2006 issued in U.S. Appl. No. 09/642,192.
U.S. Office Action mailed Jan. 20, 2010 issued in U.S. Appl. No. 11/731,406.
U.S. Final Office Action mailed Jul. 2, 2010 issued in U.S. Appl. No. 11/731,406.
U.S. Office Action mailed Jan. 19, 2011 issued in U.S. Appl. No. 11/731,406.
U.S. Office Action mailed May 18, 2004 issued in U.S. Appl. No. 10/097,507.
U.S. Final Office Action mailed May 17, 2005 issued in U.S. Appl. No. 10/097,507.
U.S. Notice of Allowance mailed Aug. 31, 2005 issued in U.S. Appl. No. 10/097,507.
U.S. Office Action mailed Dec. 24, 2009 issued in U.S. Appl. No. 11/285,898.
U.S. Final Office Action mailed May 26, 2010 issued in U.S. Appl. No. 11/285,898.
U.S. Office Action mailed Mar. 8, 2010 issued in U.S. Appl. No. 11/497,740.
U.S. Office Action Final mailed Aug. 12, 2010 issued in U.S. Appl. No. 11/497,740.
U.S. Examiner Interview Summary mailed Dec. 16, 2010 issued in U.S. Appl. No. 11/497,740.
U.S. Office Action mailed Jan. 7, 2010 issued in U.S. Appl. No. 11/881,190.
U.S. Final Office Action mailed Jun. 11, 2010 issued in U.S. Appl. No. 11/881,190.
U.S. Office Action mailed Nov. 24, 2010 issued in U.S. Appl. No. 11/881,190.
U.S. Examiner Interview Summary mailed Feb. 15, 2011 issued in U.S. Appl. No. 11/881,190.
U.S. Office Action mailed Apr. 4, 2006 issued in U.S. Appl. No. 10/230,604.
U.S. Final Office Action mailed Oct. 12, 2006 issued in U.S. Appl. No. 10/230,604.
U.S. Advisory Action mailed Jan. 31, 2007 issued in U.S. Appl. No. 10/230,604.
U.S. Notice of Panel Decision from Pre-Appeal Brief Review mailed Jun. 19, 2007 issued in U.S. Appl. No. 10/230,604.
U.S. Office Action mailed Mar. 18, 2008 issued in U.S. Appl. No. 10/230,604.
U.S. Final Office Action mailed Aug. 18, 2008 issued in U.S. Appl. No. 10/230,604.
U.S. Office Action mailed Oct. 6, 2008 issued in U.S. Appl. No. 11/224,814.

U.S. Office Action mailed Aug. 3, 2009 issued in U.S. Appl. No. 11/224,814.
U.S. Final Office Action mailed Feb. 25, 2010 issued in U.S. Appl. No. 11/224,814.
U.S. Advisory Action mailed May 18, 2010 issued in U.S. Appl. No. 11/224,814.
U.S. Notice of Allowance mailed Oct. 7, 2010 issued in U.S. Appl. No. 11/224,814.
U.S. Response to 312 Amendment mailed Nov. 26, 2010 issued in U.S. Appl. No. 11/224,814.
U.S. Office Action mailed Jul. 27, 2009 issued in U.S. Appl. No. 11/225,337.
U.S. Final Office Action mailed Feb. 1, 2010 issued in U.S. Appl. No. 11/225,337.
U.S. Advisory Action mailed Apr. 12, 2010 issued in U.S. Appl. No. 11/225,337.
U.S. Office Action mailed Jul. 19, 2010 issued in U.S. Appl. No. 11/225,337.
U.S. Examiner Interview Summary mailed Oct. 14, 2010 issued in U.S. Appl. No. 11/225,337.
U.S. Final Office Action mailed Jan. 5, 2011 issued in U.S. Appl. No. 11/225,337.
PCT International Preliminary Examination Report dated Oct. 25, 2002 issued in PCT/US01/17896.
PCT International Search Report dated Mar. 14, 2002 issued in PCT/US01/17896.
European Office Action dated Jan. 14, 2011 issued in EP 01 946 053.4-1238.
PCT International Preliminary Examination Report dated Jun. 27, 2003 issued in PCT/US01/25091.
PCT International Search Report dated Mar. 5, 2003 issued in PCT/US01/25091.
PCT International Written Opinion dated Mar. 31, 2003 issued in W02002/01725.
Australian Examiner's First Report dated Dec. 1, 2005 issued in AU2001283264.
Canadian Office Action dated Jul. 28, 2009 issued in CA 2,420,224.
Canadian Office Action dated Aug. 5, 2010 issued in CA 2,420,224.
European First Examination Report dated Feb. 10, 2009 issued in EP01962051.7.
Australian First Examination Report dated May 22, 2008 issued in AU2003200934.
Australian Examiner's First Report dated Jan. 31, 2011 issued in AU2009217419.
PCT International Search Report dated Nov. 13, 2003 issued in PCT/US2003/22180.
Australian Examiner's First Report dated Jun. 28, 2006 issued in AU2003251941.
Australian Examiner's Report No. 2 dated Aug. 8, 2006 issued in AU2003251941.
Australian Examiner's Report No. 3 dated Aug. 2, 2007 issued in AU2003251941.
Australian Examiner's First Report dated Aug. 7, 2009 issued in AU2008201281.
European Office Action dated Dec. 28, 2009 issued in EP03791582.4.
Russian Office Action (English translation) dated Apr. 10, 2007 issued in RU2005108664.
PCT International Search Report dated Apr. 7, 2008 issued in PCT/US2007/017121.
PCT Written Opinion dated Apr. 7, 2008, issued in PCT/US2007/017121.
PCT Partial International Search Report dated Jan. 25, 2008 issued in PCT/US2007/017121.
PCT International Preliminary Report on Patentability dated Feb. 3, 2009 issued in W02008/016610 (PCT/US2007/017121).
Chinese Office Action dated Jul. 31, 2009 issued in CN200780036010.9.
Chinese First Office Action dated Nov. 25, 2010 issued in CN200780036010.9.
PCT International Preliminary Report on Patentability and Written Opinion dated Jan. 9, 2008 issued in W02007/005290 (PCT/US2006/024129).
AU Examiner's First Report dated Oct. 22, 2010 issued in 2006266236.
European Summons to Attend Oral Proceedings Pursuant to Rule 115(1)EPC dated Nov. 27, 2008 issued in EP 06 773 680.1-2221.
European Consultation with Examiner dated 12/18/08 issued in EP 06 773 680.1.
European Communication of Proceedings Before the Board of Appeal dated Jun. 4, 2010 issued in EP 06 773 680.1.
PCT International Search Report dated Feb. 15, 2007 issued in WO/2007/032879 (PCT/US2006/033185).
PCT Written Opinion dated Feb. 15, 2007 issued in WO/2007/032879 (PCT/US2006/033185).
PCT International Preliminary Report on Patentability and Written Opinion dated Mar. 18, 2008 issued in PCT/US2006/033185.
Chinese First Office Action dated Sep. 25, 2009 issued in CN200680033246.2.
Chinese Second Office Action dated Sep. 10, 2010 issued in CN200680033246.2.
European Examination Report dated Jun. 2, 2008 issued in EP 06 813 743.9.
European Summons to Attend Oral Proceedings Pursuant to Rule 115(1)EPC dated Nov. 21, 2008 issued in EP06813743.9.
European Result of Consultation and Brief Communication dated Apr. 28, 2009 issued in EP06813743.9.
PCT International Search Report dated Dec. 4, 2006 issued in PCT/US2006/033429.
PCT Written Opinion dated Dec. 4, 2006 issued in PCT/US2006/033429.
PCT International Preliminary Report on Patentability and Written Opinion dated Mar. 18, 2008 issued in PCT/US2006/033429.
Australian Examiner's First Report dated Nov. 18, 2010 issued in AU 2006291294.
Australian Examiner's Report No. 2 dated Feb. 14, 2011 issued in AU 2006291294.
Chinese Office Action dated Oct. 9, 2009 issued in CN2006800335028.
PCT International Search Report dated May 7, 2010 issued in PCT/US2009/058664.
"1,001 Windows 95 Tips, Operating System Shortcuts" (1995) Synapse Adaptive.com, Access and Productivity Tools, webpage retrieved from the Internet at http://www.synapseadaptive.com/tools/Win95%20keyboard%20shortcuts.html, on Dec. 8, 2009, 1 page.
Adamec, J. (2006) "Checkraise: The Bots", Blogcritics.org News, downloaded from http://blogtronics.org/archive/2005/09/09/093200.php on Jun. 30, 2006, 3 pages.
CS Guard, Dec. 19, 2001, Half-Life www.olo.counter.com, webpage retrieved from the Internet at http://www.olo.counter-strike.pl/index.php?page=archive on Jun. 3, 2010, p. 3 of 5 pages.
Gaming Standards Association (2007), "G2S Basics," webpage retrieved from Internet at http://www.gamingstandards.com/pdfs/G2S_Sheet_final.pdf, on Sep. 5, 2008, 2 pages.
Gaming Standards Association (2007) (author unknown), "S2S Message Protocol v1.2 with Errata Sheet 1," Chapter 13, pp. 289-308. [online] retrieved from Internet on Sep. 23, 2008. http://www.gamingstandards.com/index.php?page=standards/free_downloads_standards.
Golle, Philippe et al., "Preventing Bots from Playing Online Games" ACM Computers in Entertainment, [Online] vol. 3, No. 3, Jul. 2005, pp. 1-10, XP002465544 Retrieved from the Internet: http://portal.acm.org/citation.cfm?doid=1077246.1077255.
HBP-10 Bill Dispenser, Multi-Country Platform (2001) JCM American, retrieved from the Internet at http://www.jcm-american.com/bill_dispensers.html on Sep. 20, 2001, 1 page.
HBP-5 Note Hopper (2001) JCM American, retrieved from the Internet at http://www.jcm-american.com/sub-note-hoppers.html on Sep. 20, 2001, 1 page.
"Noble Poker: Security & Integrity" (2005) advertisement from NoblePoker.com retrieved from the Internet at http://web.archive.

org/web/20050512081751/http://www.noblepoker.com on May 12, 2005, XP-002465543, 2 pages.
Oracle8™ Enterprise Edition Partitioning Option (1999), Features Overview Feb. 1999, webpage for Oracle Corporation, retrieved from the Internet at www.oracle.com/collateral/ent_partitioning_fo_pdf, Feb. 1999, 8 pgs.
PcToolsTM Guides, "Manage the CPU Task Priority," www.pctools.com, webpage retrieved from the Internet at http://www.pctools.com/guides/registry/detail.1179, Sep. 16, 2002, 2 pgs.
Spielo Gaming International (2000) webpage advertisements entitled "Visions of Tomorrow" and "PowerStation5" retrieved from the Internet at http://www.spielo.com, dated Dec. 6, 2000, 7 pages.
Wang et al., "Casino techology player tracking and slot accounting systems," Database Inspec [Online] *The Institution of Electrical Engineers*, Stevenage, GB; Database accession No. 7228747; XP002231402; abstract, 1 page.
Windows 3.1 Resource Kit, Jul. 30, 2001, Microsoft.com, retrieved from the Internet at http://support.microsoft.com/kb/83433 on Feb. 8, 2009 and on Aug. 27, 2010, 47 pages.
Hiroaki Higaki, 8 page document entitled "Group Communication Algorithm for Dynamically Updating in Distributed Systems" Copyright 1994 IEEE International Conference on Parallel and Distributed Systems (pp. 56-62) 08-8186-655-6/94, higaki@sdesun.slab.ntt.jp.
Steffen Hauptmann, et al., 12 page document entitled "On-line Maintenance With On-The-Fly Software Replacement" Copyright 1996 IEEE Proceedings, Third International Conference on Configurable Distributed Systems, (pp. 70-80) 0-8186-7395-8/96.
Hiroaki Higaki, 9 page document entitled "Extended Group Communication Algorithm for Updating Distributed Programs" Copyright 1996, IEEE, International Conference on Parallel and Distributed Systems, 0-8186-7267-6/96, , hig@takilab.k.dendai.as.jp.

* cited by examiner

METHODS AND DEVICES FOR DOWNLOADING GAMES OF CHANCE

CROSS-REFERENCE TO RELATED APPLICATIONS

This application is related to U.S. patent application Nos. 09/732,650, 10/116,424 and 11/078,966, all of which are entitled "SECURED VIRTUAL NETWORK IN A GAMING ENVIRONMENT," by Nguyen et al., which were filed on Dec. 7, 2000, Apr. 3, 2002 and Mar. 10, 2005, all of which are incorporated herein by reference in their entirety and for all purposes. These applications may sometimes be referenced herein as the "Game Downloading Applications."

BACKGROUND OF THE INVENTION

1. Field of the Invention

This invention relates to networked gaming machines such as slot machines and video poker machines. More particularly, the present invention relates to downloading games of chance to networked gaming machines.

2. Description of Related Art

Typically, utilizing a master gaming controller, the gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate a game play. These steps require the gaming machine to control input devices, such as bill validators and coin acceptors, to accept money into the gaming machine and recognize user inputs from devices, including key pads and button pads, to determine the wager amount and initiate game play. After game play has been initiated, the gaming machine determines a game outcome, presents the game outcome to the player and may dispense an award of some type depending on the outcome of the game.

The operations described above may be carried out on the gaming machine when the gaming machine is operating as a "stand alone" unit or linked in a network of some type to a group of gaming machines. As technology in the gaming industry progresses, more and more gaming services are being provided to gaming machines via communication networks that link groups of gaming machines to a remote computer that provides one or more gaming services. As an example, gaming services that may be provided by a remote computer to a gaming machine via a communication network of some type include player tracking, accounting, cashless award ticketing, lottery, progressive games and bonus games.

Currently, in a time consuming process, gaming software is manually loaded onto each gaming machine by a technician. The software is manually loaded because the gaming software is usually very highly regulated and in most gaming jurisdictions only approved gaming software may be installed on a gaming machine. Further, the gaming software is manually loaded for security reasons to prevent the source code from being obtained by individuals who might use the source code to try to find ways of cheating the gaming machine.

Therefore, one desire within the gaming industry is to electronically download gaming software to a gaming machine. The capability to electronically download gaming software is desirable because it could enable gaming machines to be quickly reconfigured to account for changes in popularity of various games played on the gaming machines. Moreover, downloading gaming software could simplify software maintenance issues on the gaming machine, such as gaming software updates. Although some methods and devices have been proposed for downloading gaming software, it would be desirable to provide methods and devices for attaining higher levels of security and convenience. Such methods and devices would preferably provide automated measures for ensuring compliance with licensing and regulatory constraints.

SUMMARY OF THE INVENTION

The present invention provides methods, devices and systems for downloading gaming software. According to some implementations of the invention, gaming software is continuously transmitted on a plurality of channels, e.g., by one or more servers. In some such implementations, each channel is dedicated to software for a different wagering game. In other implementations, gaming software components are transmitted on a plurality of channels, with each channel dedicated to a particular gaming software component. Some implementations provide gaming software in response to a request from a gaming machine. Implementations over dedicated and/or public networks are provided. Preferred implementations of the invention allow gaming software to be downloaded to gaming machines in a secure manner that automatically ensures that licensing and regulatory requirements are satisfied. Some such implementations determine whether payment is required for gaming software and provide for automated payment, if so required.

Some implementations of the invention provide a method of downloading gaming software. The method includes these steps: determining that desired gaming software is available; selecting a channel corresponding to the desired gaming software; and downloading the desired gaming software on a selected channel. The channel may be, e.g., an electromagnetic frequency range, a separate physical link, a separate virtual link or a component of a multiplexed data stream. The desired gaming software may comprise software for a whole desired wagering game or a desired software component for a wagering game.

The method may include the step of authenticating a requestor of the desired gaming software, of determining whether a license is available for the desired gaming software and/or of determining whether the desired gaming software could legally be used in a jurisdiction where the desired gaming software will be received. The method may include the step of authorizing a payment for the desired gaming software.

The method may involve beginning a download of the desired gaming software at a first arbitrary frame and completing the download of the desired gaming software at a second arbitrary frame, wherein the first arbitrary frame and the second arbitrary frame are not the first and last frames of the desired gaming software. The method may also involve detecting the whole desired wagering game from a transmission of a plurality of whole wagering games, and/or of detecting the desired software component from a transmission of a plurality of software components.

However the invention provides alternative methods for downloading gaming software in a network of gaming machines. One such method includes these steps: detecting desired software from a continuous transmission of gaming software on a channel of a gaming network; beginning a download of the desired gaming software at a first arbitrary frame; and completing the download of the desired gaming software at a second arbitrary frame. The first arbitrary frame and the second arbitrary frame are not necessarily the first and last frames of the desired software. The channel may be, for example, an electromagnetic frequency range, a separate physical link, a separate virtual link or a component of a multiplexed data stream.

The desired gaming software may comprise all components of a wagering game or a software component for a wagering game.

Another method of the invention provides software in a network of gaming machines. The method includes assigning a channel to each of a plurality of gaming software types and transmitting a gaming software type on each of a plurality of assigned channels. The gaming software type may comprise all components of a wagering game or a software component for a wagering game. The software component could be, for example, a device driver for a device installed on a gaming machine. The method may involve encrypting each of the gaming software types prior to the transmitting step.

The method may involve receiving a gaming software transaction request from a first device and authenticating an identity of the first gaming device, wherein the receiving and authenticating steps are performed prior to the transmitting step. The first device may be, for example, a gaming machine, a game server, a host device or a portable computing device. The gaming software transaction request may include access information and gaming software identification information. The access information may include, for example, operator identification information for the first gaming device, machine identification information for the first gaming device, operator identification information for the second gaming device and/or machine identification information for the second gaming device.

The method may involve determining whether a license is available for the desired gaming software and/or whether the desired gaming software could legally be used in a jurisdiction where the desired gaming software will be received, prior to the transmitting step.

All of the foregoing methods, along with other methods of the present invention, may be implemented by software, firmware and/or hardware. For example, the methods of the present invention may be implemented by computer programs embodied in machine-readable media. Some aspects of the invention can be implemented by network devices or portions thereof, such as individual blades of a blade server, and other aspects of the invention may be implemented by gaming machines.

Some embodiments of the invention provide a first gaming device configured for playing wagering games of chance. The first gaming device includes at least one network interface allowing communications between the first gaming device and a network on a plurality of channels and at least one memory device. The first gaming device also includes at least one logic device configured to do the following: prepare a request for the transfer of wagering game software from a second gaming device to the first gaming device; send the request to a software authorization agent via the network interface; and receive from the software authorization agent via the network interface a reply approving or rejecting the request for the transfer of the wagering game software. The wagering game software may be for (a) a game of chance played on a gaming machine, (b) a bonus game of chance played on a gaming machine, (c) a device driver for a device installed on a gaming machine, (d) a player tracking service on a gaming machine and/or (e) an operating system installed on a gaming machine.

The logic device may be further configured to do the following after receiving a reply accepting the request for the transfer of the wagering game software: select a channel for transfer of the wagering game software; download the wagering game software from the second gaming device via the selected channel; and store the wagering game software in the memory device. The logic device may be further configured to prepare and send a communication to the second gaming device indicating whether the wagering game software was successfully downloaded.

The request may include access information and wagering game software identification information. The access information may include, for example, operator identification information for the first gaming device, machine identification information for the first gaming device, operator identification information for the second gaming device and/or machine identification information for the second gaming device. The wagering game software identification information may include a gaming software title, a gaming software provider identifier, a gaming software version number and/or a gaming software identification number.

Gaming networks are also provided by the present invention. One such gaming network includes at least one server for providing wagering game software on a continuous transmission of wagering game software on at least one channel of the gaming network and a plurality of gaming machines for wagering games of chance. Each of the plurality of gaming machines is configured for communication with the gaming network. Moreover, each of the plurality of gaming machines is configured to do the following: detect desired wagering game software from a continuous transmission of wagering game software on a channel of the gaming network; begin a download of the desired wagering game software at a first arbitrary frame; and complete the download of the desired wagering game software at a second arbitrary frame.

The first arbitrary frame and the second arbitrary frame are not necessarily the first and last frames of the desired wagering game software. The desired wagering game software may include software for a whole desired wagering game or a desired software component for a wagering game. The gaming machines are also configured for accepting a wager for a desired wagering game and for presenting the desired wagering game.

These and other features of the present invention will be presented in more detail in the following detailed description of the invention and the associated figures.

BRIEF DESCRIPTION OF THE DRAWINGS

The invention may best be understood by reference to the following description taken in conjunction with the accompanying drawings, which are illustrative of specific implementations of the present invention.

DESCRIPTION OF THE PREFERRED EMBODIMENTS

Figure 1:
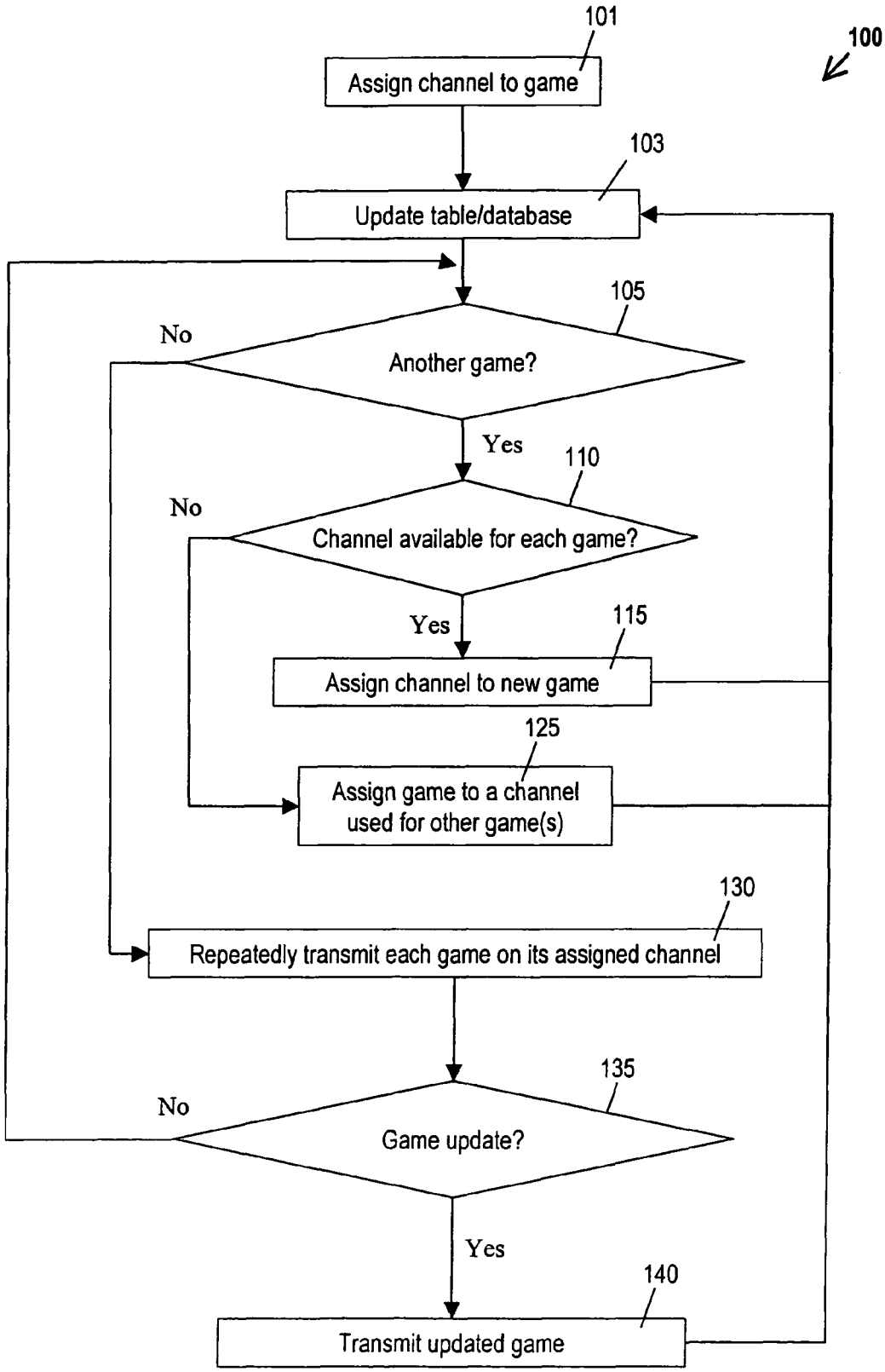
FIG. 1 is a flow chart that outlines one method according to the present invention.

Reference will now be made in detail to some specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. Moreover, numerous specific details are set forth below in order to provide a thorough understanding of the present invention. The present invention may be practiced without some or all of these specific details. In other instances, well known process operations have not been described in detail in order not to obscure the present invention.

The present invention provides novel method and devices for managing gaming machine networks, e.g., for the secure and convenient downloading of gaming software. Although the current description primarily describes networked gaming machines, some implementations of the invention apply equally to similar types of machines, such as video lottery terminals and similar devices that are used primarily to display a game outcome.

According to some implementations of the invention, gaming software is regularly transmitted (and in some implementations, continuously transmitted) on a plurality of channels, e.g., by one or more servers. As used herein, the term "channel" and the like will be broadly construed. In general, a "channel" will mean a communication path and/or a set of properties that distinguishes the communication path. For example, a channel could refer to a specific bandwidth or frequency range of the electromagnetic spectrum. A channel could also be a physical communication path. A channel could refer to a portion of a communication (e.g., a portion of a multiplexed communication) on a physical communication path. A channel could also refer to all or a portion of a virtual communication path, such as a virtual local area network ("VLAN").

Some implementations of the invention involve assigning gaming software to a plurality of channels. In some such implementations, each of a plurality of channels is allocated to software for a different wagering game. Other implementations apportion the channels in different ways, e.g., according to the capabilities of the gaming machine, available licenses and/or jurisdictional requirements. For example, some implementations of the invention apportion Class II games and Class III games to different channels.

Alternative implementations will have software for more than one wagering game on a channel. In some such implementations, multiple games having a common characteristic may be allocated to a particular channel.

In other implementations, gaming software components are transmitted on a plurality of channels, with each channel dedicated to a particular gaming software component. For example, some implementations of the invention provide a separate channel for graphics, another for one or more peripheral devices, etc. Some implementations provide for transmission of gaming software on one or more "internationalization" channels, which provide software for customizing a wagering game according to the language, the currency, etc., of the country in which the wagering game will be played.

In some such implementations, textual statements as well as date/time, numbers, and currency are displayed on a game using the language of the player's country. To display textual statements, the software may have a binary value for each statement that it displays. When it is time to display a statement, the software uses the binary value to locate the statement in a data file, load the statement from the data file into memory and display the statement. To display date/time (including calendar), numeric, and currency information, the software may have a binary value that indicates which format to use when displaying data. When it is time to display the data, the software uses the binary value to locate the formatting instructions in a data file (typically the same data file that contains all the textual statements), load the instructions into memory, format the data for display according to the instructions, and display the resulting text. The data file, or its contents, can be considered as a "software component" and downloaded as such, for example as shown and described herein with reference to steps 201, 205, 210, 220, 225, 230, and 235 of FIG. 2.

Although many implementations of the invention provide for gaming software to be transmitted regularly whether or not gaming software has been requested ("push mode"), some implementations of the invention provide gaming software in response to a request ("pull mode"), e.g., from a gaming machine, from an operator, from a host device, etc. Whether operating in push or pull mode, either case, preferred implementations of the invention require that a recipient of gaming software be authenticated. Moreover, some implementations of the invention allow gaming software to be transferred in a manner that satisfies game licensing requirements and/or regulatory requirements of the gaming jurisdiction where the gaming machine is located.

FIG. 1 is a flow chart that outlines the broad features of one method 100 according to the present invention. The steps of method 100 can be performed, for example, by a game server according to instructions from an operator, instructions in a software program, etc. Those of skill in the art will appreciate that the steps of the methods shown and described herein, including but not limited to method 100, need not be performed (and in some implementations are not performed) in the order indicated. Moreover, some implementations of these methods may include more or fewer steps than those indicated herein.

In method 100, a channel is assigned to software for each of a plurality of wagering games. The channel will be assigned according to the types of channels available on the network. For example, if only one physical communication path will be available for downloading game software, the channel could be assigned by allocating a portion of a multiplexed data transmission on the physical communication path. In such embodiments, there is an implied step of muliplexing data for transmission on the communication path that is not shown in FIG. 1. According to method 100, software components for a whole wagering game (e.g., all of the software components necessary for the game) are allocated to each assigned channel.

In step 101, a channel is assigned to software for a particular wagering game. In step 103, the channel/game association is recorded in some convenient format, e.g., in a data structure such as a look-up table. In step 105, it is determined whether there is software for another game. If so, it is determined whether there is a channel available for transmission of the game software. (Step 110). If a channel is available, that channel is assigned to the game (step 115) and the table/ database is updated. (Step 103). This assignment process continues until all games that will be transmitted are assigned to a channel and then the game software is repeatedly transmitted on its respective channel. (Step 130.)

In some implementations of method 100, only one game is transmitted on a particular channel. However, if the number of available games exceeds the number of available channels, a game will be assigned to a channel used for another game. (Step 125.) The software for each game on the channel may be distinguished from other games according to information encoded in a header or other field, according to a known position in a sequence of games, etc. For example, software for N wagering games could be transmitted on the same channel in a repetitive fashion, e.g., games 1 through N, 1 through N and so on. A game's position in the sequence of 1 through N could be used to determine the identity of the game.

In alternative implementations, software for more than one game is normally transmitted on the same channel. In some such implementations, multiple games having a common characteristic may be allocated to a particular channel. For example, one channel may be allocated to Class III poker games, another channel may be allocated to Class II games having poker-like attributes, another channel may be allocated to games having a particular theme (e.g., a Star Wars or "space" theme), another channel may be allocated to software for the most popular wagering games, etc.

However, in the current example, each channel has been allocated to software for a particular wagering game. Accordingly, in step 130, the software for each wagering game is transmitted on its respective channel. The software is transmitted repetitively, and in some implementations is transmitted continuously, until a change occurs. For example, if an updated version of a game is received for transmission (as determined in step 135) by the game server, an operator, etc., the software transmission for that game will be updated. (Step 140).

In implementations wherein software for a single game is transmitted on each channel, step 140 will involve replacing the older version of the gaming software with the newer version of the gaming software on that channel. For alternative implementations wherein software for more than one game is transmitted on the channel, the newer version of the gaming software will be added to the data stream/sequence on that channel, preferably in the position of the data stream/sequence that had been occupied by the older version of the gaming software. When an update is made or a new game is transmitted, a record is made of this event. (Step 103).

Figure 2:
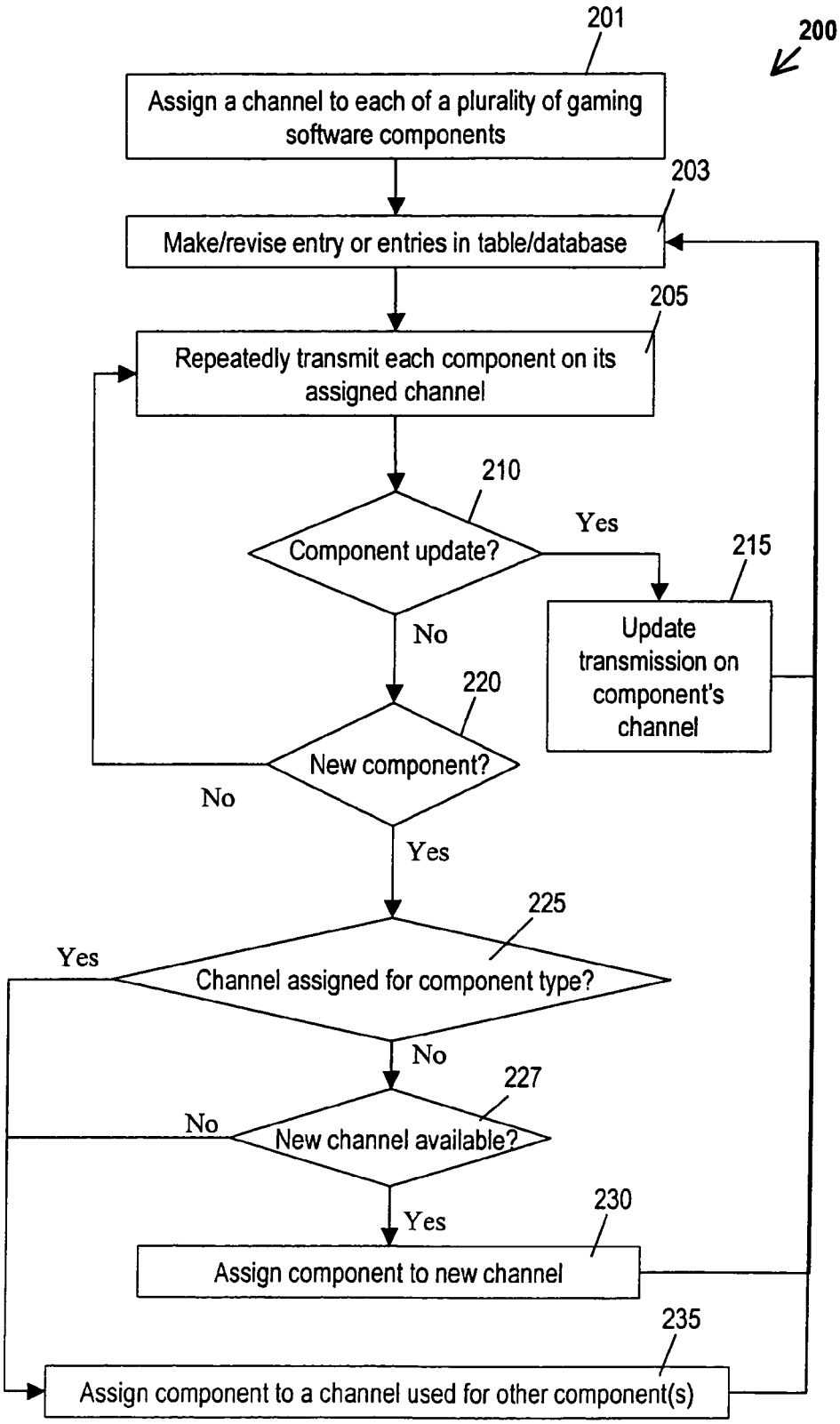
FIG. 2 is a flow chart that outlines an alternative method according to the present invention.

As will now be described with reference to FIG. 2, some implementations of the invention involve allocating software for one or more components of wagering games to a plurality of channels. The steps of method 200 can be performed, for example, by a game server according to instructions from an operator, instructions in a software program, etc.

In step 201, a channel is assigned to each of a plurality of software component types. Preferably, there is a logical connection between the software components that are assigned to a given channel. For example, one channel may be assigned to graphics, another to paytables, another to peripheral devices, etc. In step 203, table entries are made according to the software components assigned to each channel and in step 205, the software components are repeatedly transmitted on each channel.

In step 210, it is determined whether there is an update for any software component. If so, the software component is updated (step 215) and a record is made of the update (step 203).

Similarly, in step 220 it is determined whether a new software component is received for transmission. If a new component has been received, it is determined whether a channel is has already been assigned for the type of component that has been received. (Step 225.) If such a channel has already been assigned, the new software component will be assigned to that channel. (Step 235.) For example, if the new software component is graphics software and a graphics channel has already been established, the new software component will be assigned to the existing graphics channel (step 235) and the table/database will be updated (step 203).

If no channel has yet been assigned for the type of the new component, it is determined in step 227 whether there is a channel available for the new component type. If there is another channel available, the new software component will be assigned to the available channel. (Step 230.) If no more channels as available, the new software component will be assigned to an existing channel (step 235). In either case, the table/database will be updated to indicate the channel on which the new software component will be transmitted. (Step 203).

Some implementations of the present invention provide methods for accessing and downloading transmissions of game software, including game component software. Some aspects of these methods may be performed by a gaming machine or by another device, e.g., a PDA or a networked host device, under the control of software and/or an operator. Other aspects of these methods may be performed by another gaming device that functions as a software authorization agent. In some implementations, a game server can also function as a software authorization agent, but in preferred implementations a third device acts as the software authorization agent.

Figure 3:
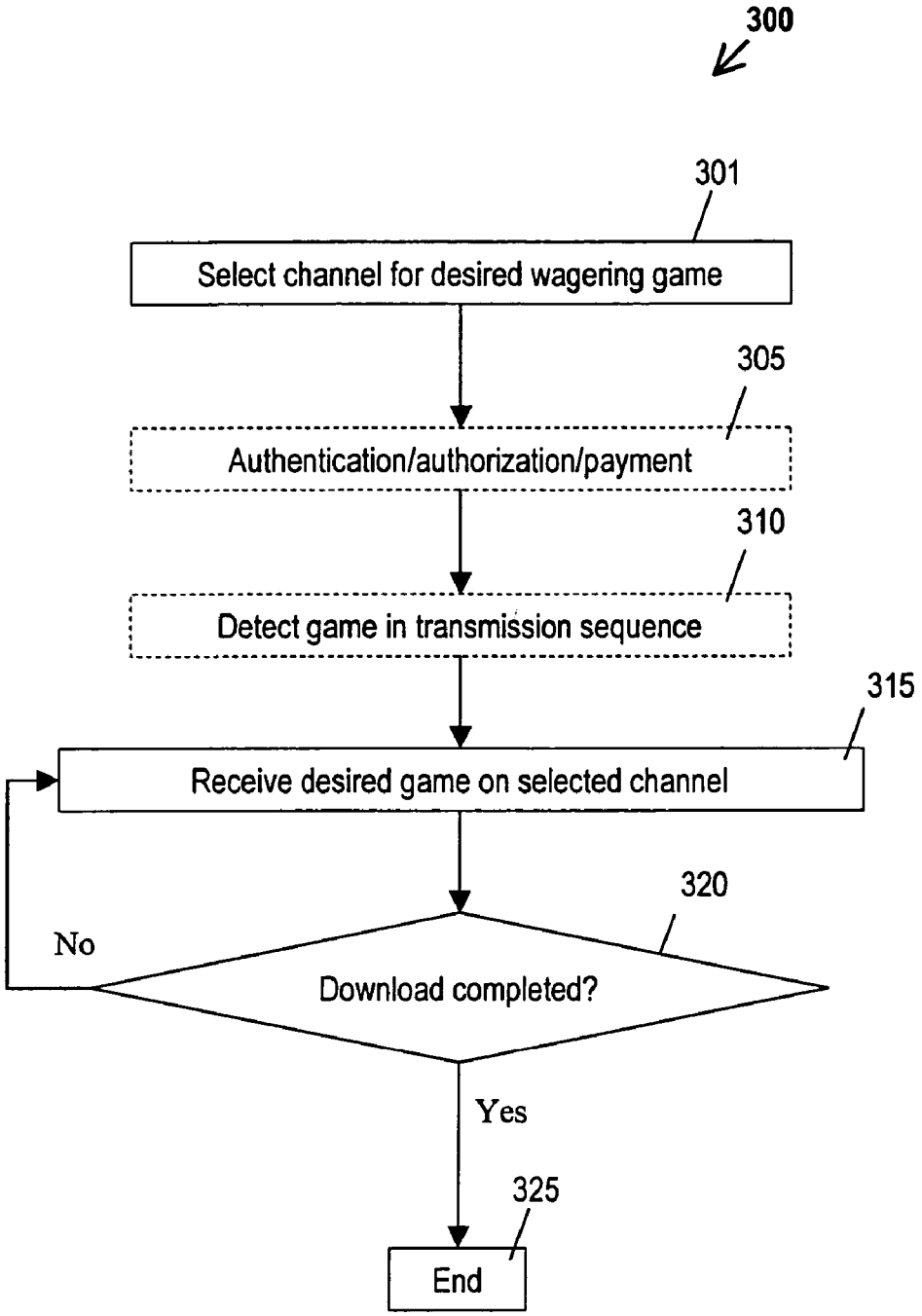
FIG. 3 is a flow chart that outlines another method according to the present invention.

Method 300 is outlined in the flow chart depicted in FIG. 3. In step 301, a channel is selected for a desired wagering game or type of wagering game. In some implementations of the invention (e.g., within a secure and dedicated gaming network), no additional payment will be required and no authentication and/or authorization steps will be required. However, even within a secure network it is preferable, at the least, to authenticate a requestor of a game download.

For example, a software authorization agent may need to authenticate a requestor and approve access to game software transmissions before any downloading can take place. The approval process may be based not only upon the outcome of an authentication process but also upon an evaluation of pertinent licensing data, gaming regulatory requirements, etc. Optional step 305 may include various authentication, authorization and payment procedures that are described in the "Game Downloading Applications." Some relevant methods and devices are described below with reference to FIG. 5 et seq.

As noted above, in some implementations of the invention, software for more than one game will be transmitted on the same channel. Therefore, some corresponding implementations of the invention involve detecting a desired game within a transmission sequence on a selected channel. Some implementations of the invention perform step 310 by inspecting header information or the like of data transmitted on the selected channel. Other implementations of the invention perform step 310 by selecting desired gaming software from a known sequence of games that are transmitted on the selected channel. For example, if software for N wagering games is transmitted on the same channel in a repetitive fashion, e.g., games 1 through N, 1 through N and so on, a game's known position in the sequence of 1 through N may be used to detect the desired game software. Information for performing step 310 may be stored, for example, in step 103 of method 100. Such information may be transmitted to the gaming machine, e.g., after successful completion of the aforementioned authentication, authorization and payment steps.

Step 315 involves the receipt of the desired gaming software on the selected channel. In step 320, it is determined whether the download is completed; if not, the downloading process continues (step 315) until normal completion and then the process ends. As will be appreciated by those of skill in the art, the download should be re-attempted if the software is received with errors, e.g., as determined by a checksum process. If the download is missing a frame and/or if one or more frames have an error, then a successful download may be attempted during the next download cycle.

If software for only one game is being transmitted on the selected channel, the downloading process may begin at any arbitrary part (e.g., any packet, frame, etc.) of the transmission. For example, if the receiving device has received information indicating the size (e.g., in bytes) of the game software to be downloaded, it may simply begin downloading the first received part of the transmission and continue until the known number of bytes has been received. Alternatively (or additionally, as a check), the receiving device may wait until the beginning of the desired software is received, download the gaming software from start to finish, and then stop.

Figure 4:
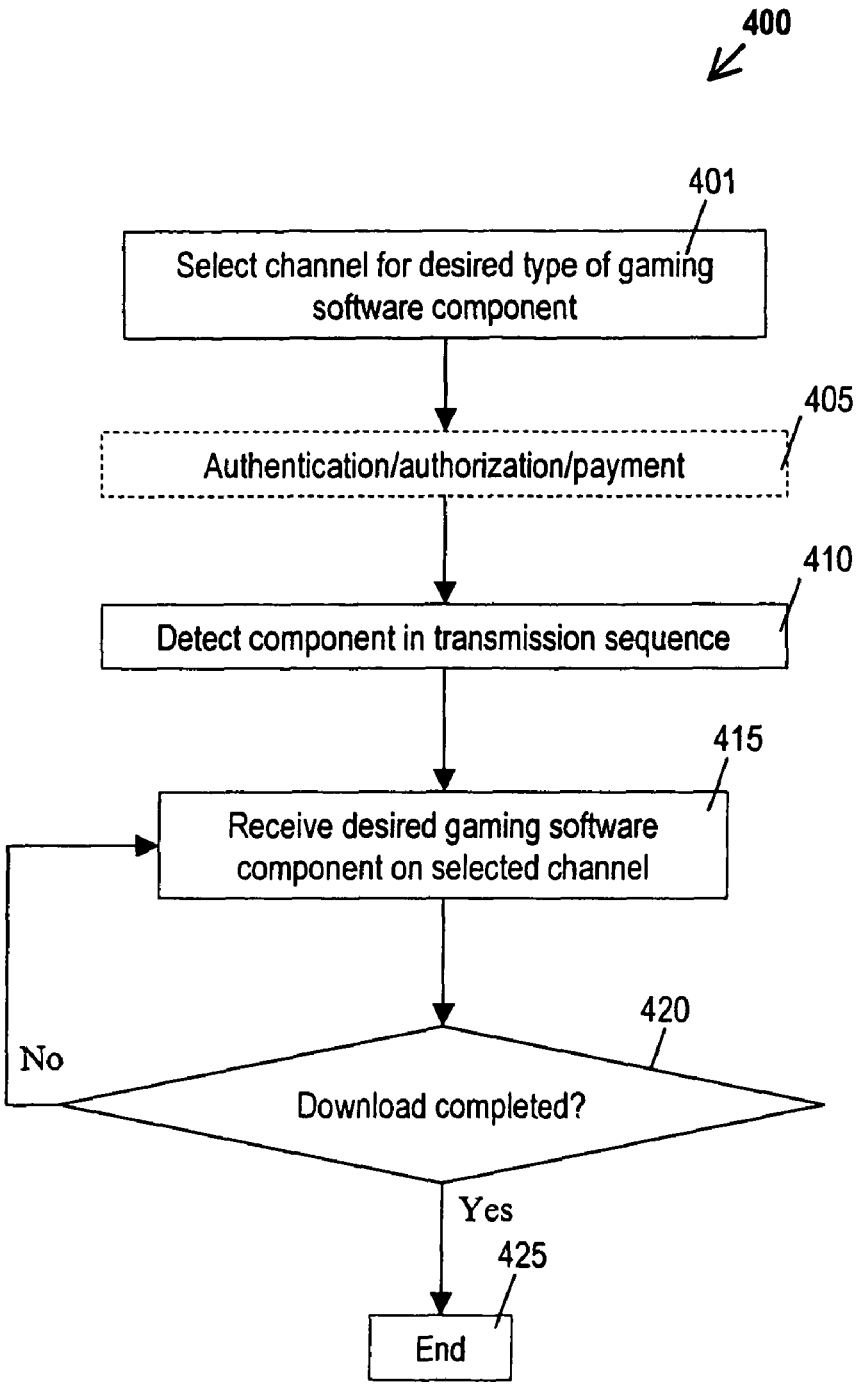
FIG. 4 is a flow chart that outlines yet another method according to the present invention.

As illustrated in FIG. 4, method 400 of the invention provides for the downloading of gaming software components. In step 401, a channel for a desired type of gaming software component is selected. For example, an operator may desire to upgrade the peripheral software for a particular game to the latest version. The operator could select a channel assigned to the transmission of peripheral code, e.g., by operating a portable computing device that is in communication with a gaming machine via a network. As described above with reference to step 305 of method 300, optional step 405 may involve authentication, authorization and/or payment.

Generally speaking (although not in all implementations), software components for more than one type of wagering game (e.g., peripheral software for more than one game) will be transmitted on each channel. Accordingly, the receiving device (here, a gaming machine), detects the desired gaming software component from a sequence of multiple gaming software components. (Step 410.) The software component is downloaded until it is determined that the download is complete (step 420), at which time the process ends.

According to some implementations of the invention, games and/or components are downloaded repeatedly and continuously. However, it is important that downloads should not saturate the network's bandwidth. Therefore, some implementations of the invention provide some form of flow-control functionality.

For example, some such implementations interleave download-specific frames with other frames transmitted over the network. One such implementation uses a variable interleave ratio such that only N % (e.g., a value in the range of 1% to 10%) of the bandwidth is apportioned to download frames when the network is busy while M % (e.g., a value in the range of 25% to 90%) is apportioned to download frames when the network is lightly loaded. It will be appreciated that other values of N and/or M may be used.

Another such implementation uses a priority scheme where each frame type is given a priority. In some such implementations, download frames could be assigned a relatively low priority. If download frames are given a low priority and network traffic is light, then download frames will consequently occupy most of the available bandwidth until network traffic increases. Conversely, if network traffic is heavy, download frames will comprise a relatively lower percent of network traffic. Some flow control implementations are "hybrid" versions of the foregoing examples, e.g., wherein download frames are assigned a relatively low priority, but still have a minimum guaranteed bandwidth.

Figure 5:
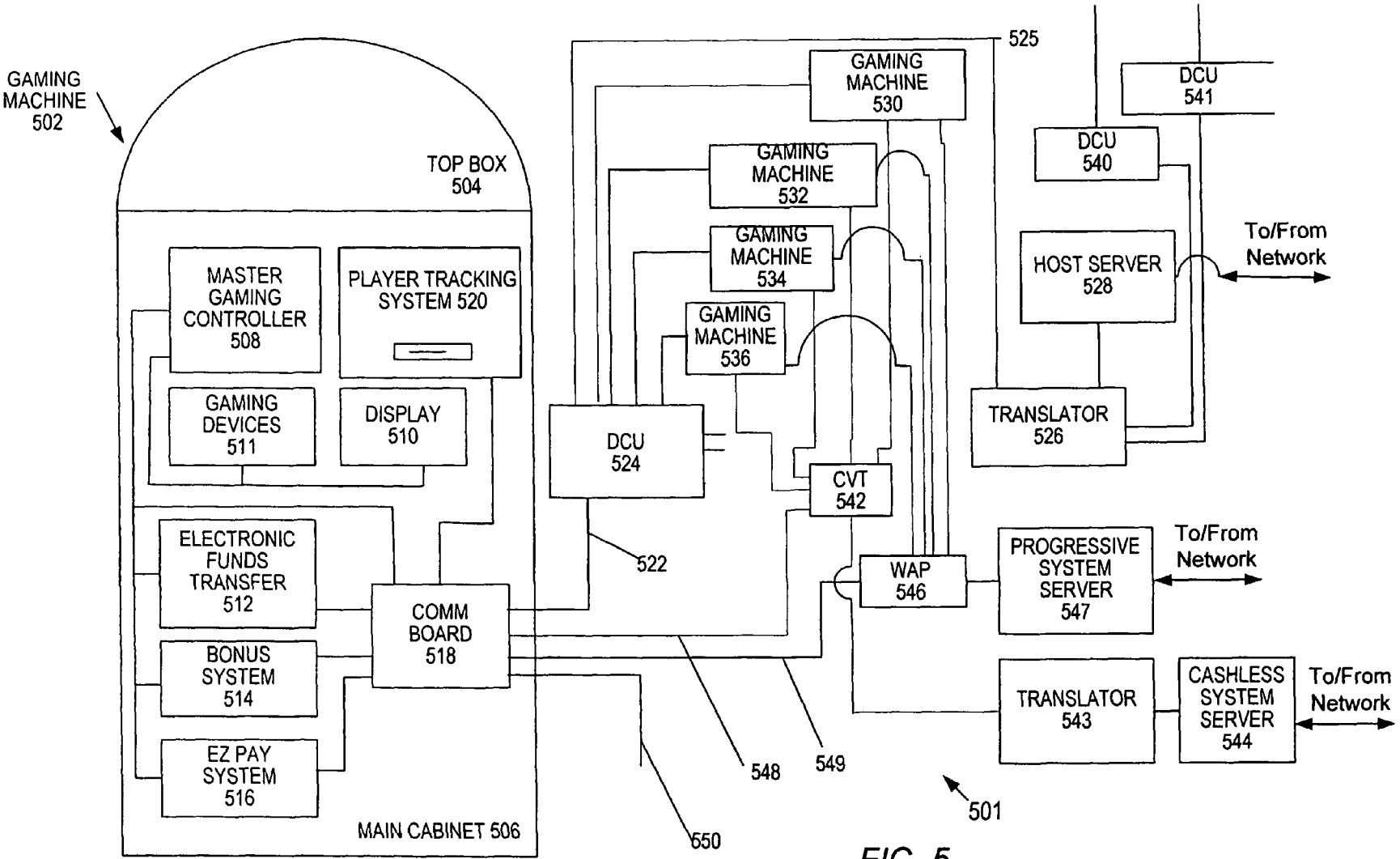
FIG. 5 is a block diagram that illustrates a gaming device and a portion of a gaming network that may be used to implement various embodiments of the present invention.

FIG. 5 is a simplified block diagram depicting, inter alia, gaming machines within gaming establishment 501. The gaming machines are connected with a dedicated communication network via a host server and a data collection unit ("DCU") according to one embodiment of the invention. According to some embodiments of the invention, the DCU is an enhanced DCU as described in U.S. patent application Ser. No. 10/187,059, entitled "Redundant Gaming Network Mediation," which is hereby incorporated by reference in its entirety.

In FIG. 5, gaming machine 502, and the other gaming machines 530, 532, 534, and 536, include a main cabinet 506 and a top box 504. The main cabinet 506 houses the main gaming elements and can also house peripheral systems, such as those that utilize dedicated gaming networks. The top box 504 may also be used to house these peripheral systems.

The master gaming controller 508 controls the game play on the gaming machine 502 and receives or sends data to various input/output devices 511 on the gaming machine 502. The master gaming controller 508 may also communicate with a display 510.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 508 may also communicate with EFT system 512, bonus system 514, EZPay™ system 516 (a proprietary cashless ticketing system of the present assignee), and player tracking system 520. The systems of the gaming machine 502 communicate the data onto the network 522 via a communication board 518.

In some implementations, the dedicated communication network is not accessible to the public. Due to the sensitive nature of much of the information on the dedicated networks, for example, electronic fund transfers and player tracking data, usually the manufacturer of a host system, such as a player tracking system, or group of host systems, employs a particular networking language having proprietary protocols. For instance, 10-20 different companies produce player tracking host systems where each host system may use different protocols. These proprietary protocols are usually considered highly confidential and not released publicly. Thus, whenever a new host system is introduced for use with a gaming machine, rather than trying to interpret all the different protocols utilized by different manufacturers, the new host system is typically designed as a separate network. Consequently, as more host systems are introduced, the independent network structures continue to build up in the casino. Examples of protocol mediation to address these issues may be found, for example, in U.S. Pat. No. 6,682,423, "Open Architecture Communications in a Gaming Network," which is hereby incorporated by reference in its entirety.

Further, in the gaming industry, many different manufacturers make gaming machines. The communication protocols on the gaming machine are typically hard-coded into the gaming machine software, and each gaming machine manufacturer may utilize a different proprietary communication protocol. A gaming machine manufacturer may also produce host systems, in which case their gaming machines are compatible with their own host systems. However, in a heterogeneous gaming environment, such as a casino, gaming machines from many different manufacturers, each with their own communication protocol, may be connected to host systems from many different manufacturers, each with their own communication protocol. Therefore, communication compatibility issues regarding the protocols used by the gaming machines in the system and protocols used by the host systems must be considered.

In the present illustration, the gaming machines, 502, 530, 532, 534, and 536 are connected to a gaming network 522. In general, the DCU 524 functions as an intermediary between the different gaming machines on the network 522 and the host server 528. In general, the DCU 524 receives data transmitted from the gaming machines and sends the data to the host server 528 over a transmission path 525. In some instances, when the hardware interface used by the gaming machine is not compatible with the host server 528, a translator 526 may be used to convert serial data from the DCU 524 to a format accepted by the host server 528. The translator may provide this conversion service to a plurality of DCUs, such as 524, 540 and 541.

Further, in some dedicated gaming networks, the DCU 524 can receive data transmitted from the host server 528 for communication to the gaming machines on the gaming network. The received data may be communicated synchronously to the gaming machines on the gaming network. Within a gaming establishment, the gaming machines 502, 530, 532, 534 and 536 are located on the gaming floor for player access while the host server 528 is usually located in another part of gaming establishment 501 (e.g. the backroom), or at another location.

In a gaming network, gaming machines, such as 502, 530, 532, 534 and 536, may be connected through multiple communication paths to a number of gaming devices that provide gaming services. For example, gaming machine 502 is connected to four communication paths, 522, 548, 549 and 550. As described above, communication path 522 allows the gaming machine 502 to send information to host server 528.

Via communication path 548, the gaming machine 502 is connected to a clerk validation terminal 542. The clerk validation terminal 542 is connected to a translator 543 and a cashless system server 544 that are used to provide cashless gaming services to the gaming machine 502. In this implementation, other gaming machines in gaming establishment 501, including gaming machines 530, 532, 534 and 536, are also connected to clerk validation terminal 542 and also receive cashless system services. Moreover, in this implementation, cashless system server 544 is in communication with a network, which may include connectivity to gaming establishments other than gaming establishment 501. Accordingly, cashless system server 544 may provide cashless system services to gaming machines located in other gaming establishments.

Via communication path 549, the gaming machine 502 is connected to a wide area progressive (WAP) device 546. The WAP is connected to a progressive system server 547 that may be used to provide progressive gaming services to gaming machines in and, in this example, to gaming establishments other than gaming establishment 501. The progressive game services enabled by the progressive game network increase the game playing capabilities of a particular gaming machine by enabling a larger jackpot than would be possible if the gaming machine was operating in a "stand alone" mode. Playing a game on a participating gaming machine gives a player a chance to win the progressive jackpot. The potential size of the jackpot increases as the number of gaming machines connected in the progressive network is increased. The size of the jackpot tends to increase game play on gaming machines offering a progressive jackpot.

Gaming machines 530, 532, 534 and 536 are connected to WAP device 546 and progressive system server 547. Other gaming machines may also be connected to WAP device 546 and/or progressive system server 547, as will be described below with reference to FIG. 2. Via communication path 550, the gaming machine 502 may be connected with additional gaming devices (not shown) that provide other gaming services.

In some embodiments of the present invention, gaming machines and other devices in the gaming establishment depicted in FIG. 5 are connected to a central system and/or other gaming establishments via one or more networks, which may be public or private networks. In this example, host server 528, progressive system server 547 and cashless system server are connected to an outside network. In other embodiments, a bingo server, a switch, or another type of network device may be part of an interface with an outside network. In some embodiments, a single network device links a gaming establishment with another gaming establishment and/or a central system. Such a network device will sometimes be referred to herein as a "site controller."

Figure 5A:
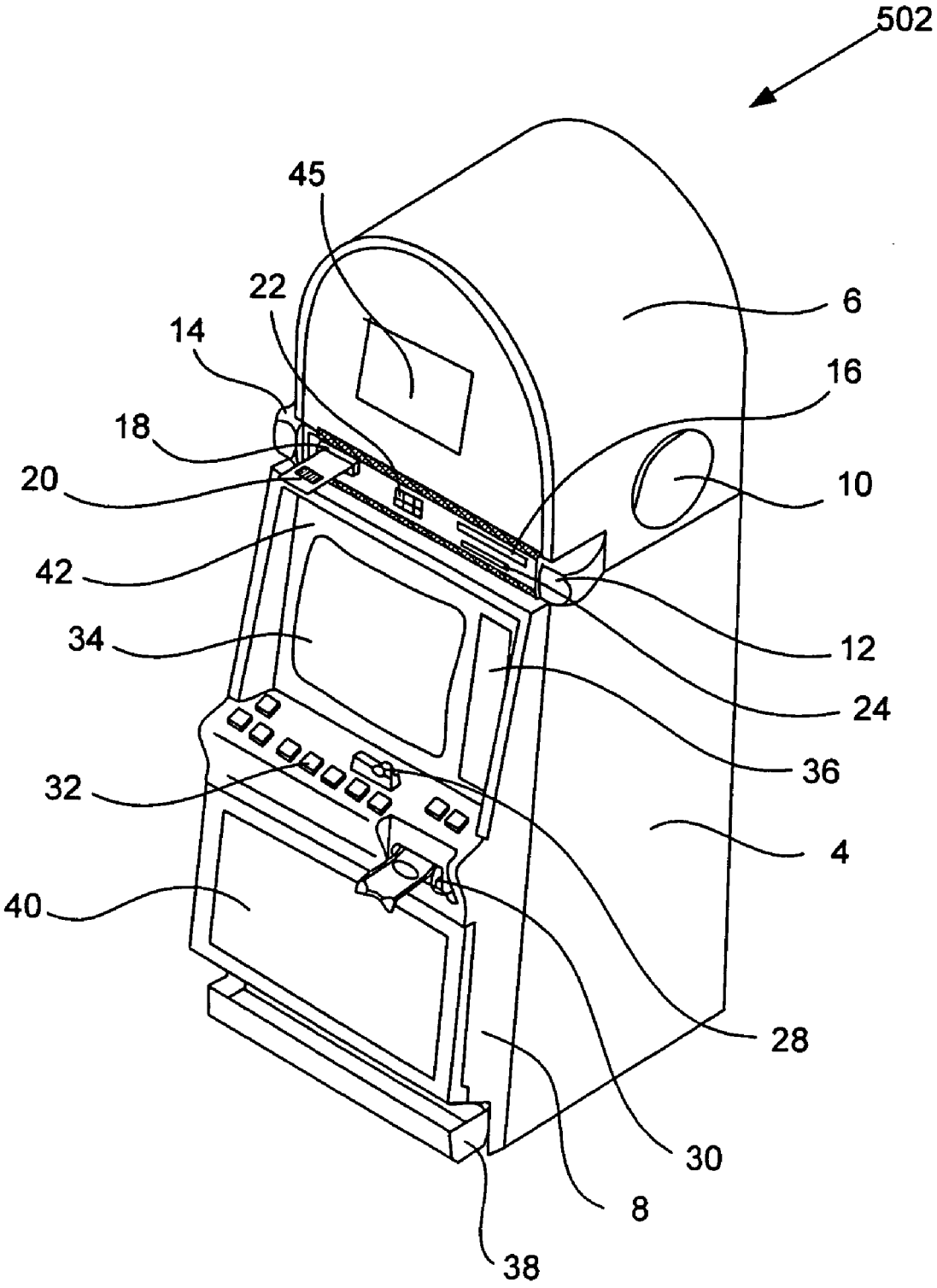
FIG. 5A depicts a gaming machine that may be configured according to some implementations of the present invention.

Turning to FIG. 5A, more details of gaming machine 502 are described. Machine 502 includes a main cabinet 4, which generally surrounds the machine interior (not shown) and is viewable by users. The main cabinet 4 includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. The information panel 36 may be a back-lit, silk screened glass panel with lettering to indicate general game information including, for example, the number of coins played. The bill validator 30, player-input switches 32, video display monitor 34, and information panel are devices used to play a game on the gaming machine 502. The devices are controlled by circuitry housed inside the main cabinet 4 of the machine 502.

The gaming machine 502 includes a top box 6, which sits on top of the main cabinet 4. The top box 6 houses a number of devices, which may be used to add features to a game being played on the gaming machine 502, including speakers 10, 12, 14, a ticket printer 18 which may print bar-coded tickets 20 used as cashless instruments. The player tracking unit mounted within the top box 6 includes a key pad 22 for entering player tracking information, a florescent display 16 for displaying player tracking information, a card reader 24 for entering a magnetic striped card containing player tracking information, a microphone 43 for inputting voice data, a speaker 42 for projecting sounds and a light panel 44 to display various light patterns used to convey gaming information. In other embodiments, the player tracking unit and associated player tracking interface devices, such as 16, 22, 24, and 42, may be mounted within the main cabinet 4 of the gaming machine, on top of the gaming machine, or on the side of the main cabinet of the gaming machine.

Understand that gaming machine 502 is but one example from a wide range of gaming machine designs on which the present invention may be implemented. For example, not all suitable gaming machines have top boxes or player tracking features. Further, some gaming machines have two or more game displays—mechanical and/or video—and, some gaming machines are designed for bar tables and have displays that face upwards. Still further, some machines may be designed entirely for cashless systems. Such machines may not include such features as bill validators, coin acceptors and coin trays. Instead, they may have only ticket readers, card readers and ticket dispensers. Those of skill in the art will understand that the present can be deployed on most gaming machines now available or hereafter developed.

Some preferred gaming machines of the present assignee are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in IGT gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Each function of the game (bet, play, result, etc.) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, etc. This is critical to ensure the player's wager and credits are preserved. Typically, battery backed RAM devices are used to preserve this critical data. These memory devices are not used in typical general-purpose computers.

IGT gaming computers normally contain additional interfaces, including serial interfaces, to connect to specific subsystems internal and external to the slot machine. The serial devices may have electrical interface requirements that differ from the "standard" EIA RS232 serial interfaces provided by general-purpose computers. These interfaces may include EIA RS485, EIA RS422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents in a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 5A, when a user wishes to play the gaming machine 502, he or she inserts cash through the coin acceptor 28 or bill validator 30. In addition, the player may use a cashless instrument of some type to register credits on the gaming machine 502. For example, the bill validator 30 may accept a printed ticket voucher, including 20, as an indicium of credit. As another example, the card reader 24 may accept a debit card or a smart card containing cash or credit information that may be used to register credits on the gaming machine.

During the course of a game, a player may be required to make a number of decisions, which affect the outcome of the game. For example, a player may vary his or her wager on a particular game, select a prize for a particular game, or make game decisions regarding gaming criteria that affect the outcome of a particular game. The player may make these choices using the player-input switches 32, the video display screen 34 or using some other device which enables a player to input information into the gaming machine.

During certain game functions and events, the gaming machine 502 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 502, from lights behind the belly glass 40 or the light panel on the player tracking unit 44.

After the player has completed a game, the player may receive award credits, game tokens from the coin tray 38 or the ticket 20 from the printer 18, which may be used for further games or to redeem a prize. Further, the player may receive a ticket 20 for food, merchandise, or games from the printer 18. The type of ticket 20 may be related to past game playing recorded by the player tracking software within the gaming machine 502. In some embodiments, these tickets may be used by a game player to obtain game services.

Figure 6:
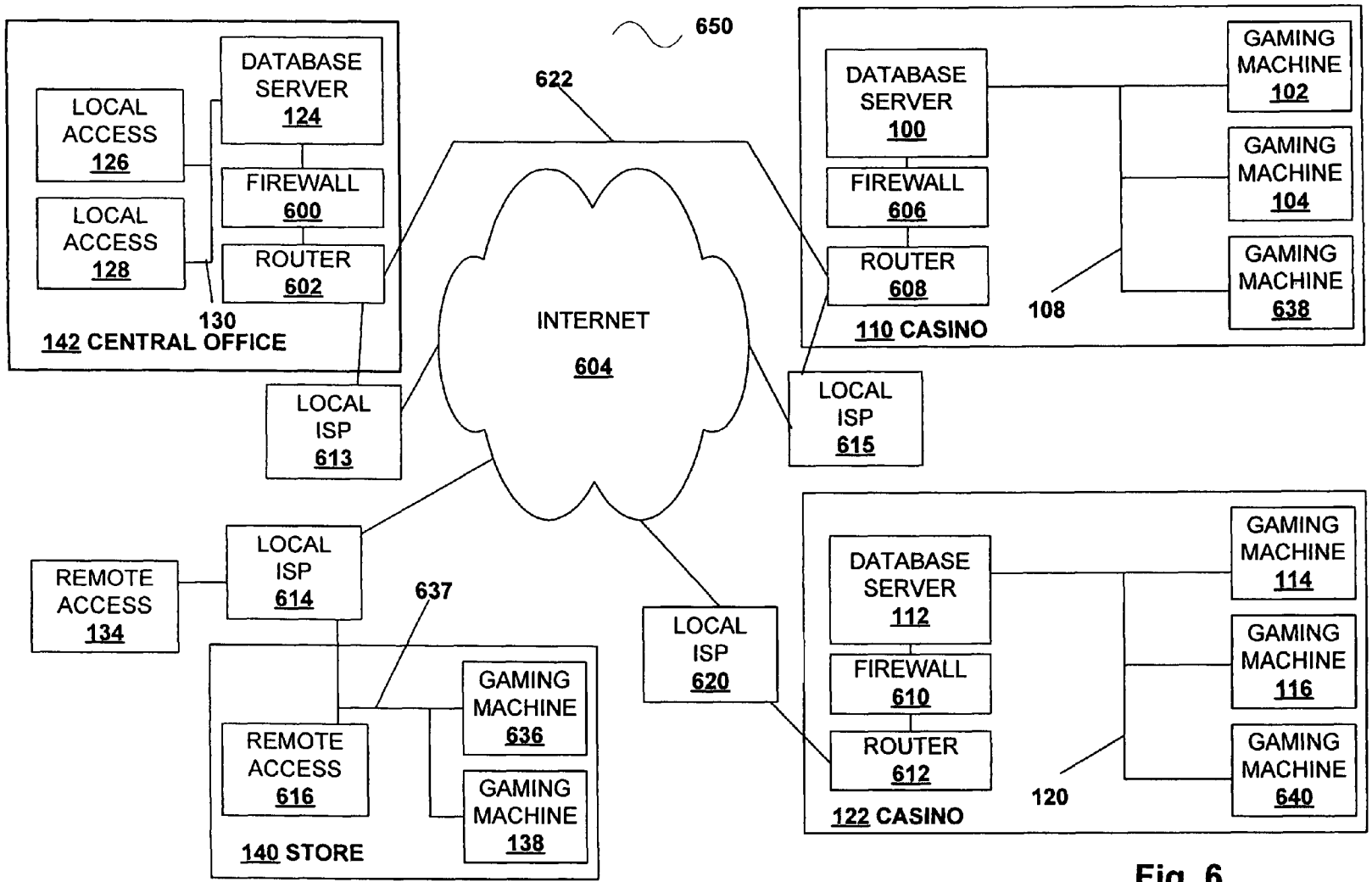
FIG. 6 is a block diagram depicting gaming machines distributed in different establishments.

FIG. 6 is a block diagram depicting gaming machines distributed in different establishments connected using a secure virtual network. Using the secure virtual network, network gaming services, data acquisition and data access may be provided to a large number of gaming machines distributed throughout a gaming entity 650 from a central location such as the central office 142. These services may be provided to gaming machines that have traditionally operated in a "stand alone" mode such as gaming machine 636 and 138 in the store 140. In FIG. 6, some of the communication infrastructure necessary to implement a secure virtual network for one embodiment of the present invention are described.

In one embodiment, the secured virtual network may be an IP based Virtual Private Networks (VPNs). An Internet-based virtual private network (VPN) uses the open, distributed infrastructure of the Internet to transmit data between corporate sites. A VPN may emulate a private IP network over public or shared infrastructures. A VPN that supports only IP traffic is called an IP-VPN. Virtual Private Networks provide advantages to both the service provider and its customers. For its customers, a VPN can extend the IP capabilities of a corporate site to remote offices and/or users with intranet, extranet, and dial-up services. This connectivity may be achieved at a lower cost to the gaming entity with savings in capital equipment, operations, and services. Details of VPN methods that may be used with the present invention are described in the reference, "Virtual Private Networks-Technologies and Solutions," by R. Yueh and T. Strayer, Addison-Wesley, 2001, ISBN#0-201-70209-6, which is incorporated herein by reference and for all purposes.

There are many ways in which IP VPN services may be implemented, such as, for example, Virtual Leased Lines, Virtual Private Routed Networks, Virtual Private Dial Networks, Virtual Private LAN Segments, etc. Additionally VPNs may be implemented using a variety of protocols, such as, for example, IP Security (IPSec) Protocol, Layer 2 Tunneling Protocol, Multiprotocol Label Switching (MPLS) Protocol, etc. Details of these protocols including RFC reports may be found from the VPN Consortium, an industry trade group (http://www.vpnc.com, VPNC, Santa Cruz, Calif.).

In FIG. 6, a number of embodiments of IP VPN services are implemented to allow connectivity between the various gaming machines and database servers in the gaming entity. For instance, the gaming machine 636 in the store 140 may directly communicate with the database server 124 in the central office 142 via the internet 604. The communication path between the gaming machine 636 and the database server 124 may be the local ISP 614, a number of routers on the Internet 604, a local ISP 613 accessed by the central office 142, the router 602 and the firewall 600. The firewall may be hardware, software or combinations of both that prevent illegal access of the gaming machine by an outside entity connected to the gaming machine. For instance, an illegal access may be an attempt to plant a program in the database server that alters the operation of the database server or allows someone to steal data. The internal firewall is designed to prevent someone such as a hacker from gaining illegal access to the gaming machine and tampering with it in some manner. Firewalls and routers used in FIG. 6 may be provided by Cisco Systems (San Jose, Calif.).

The network interface between the gaming machine 636 and the local ISP may be a wireline interface, such as a wired Ethernet connection, a wired ATM connection, or a wired frame relay connection, or a wireless interface, such as a wireless cellular interface. For instance, the gaming machine 636 may include a wireless modem and an antenna that allows the gaming machine to connect with the local ISP 614. As another example, the gaming machine may contain a dial-in modem, a DSL modem or a cable modem that allows that gaming machine 636 to connect with the local ISP 614 via a coaxial cable or phone line 637. The gaming machine 636 may also contain an internal firewall to prevent illegal access to the gaming machine. Other gaming machines, such as 638 and 640, located at various locations throughout the gaming entity 650 may also include the hardware described above and transmit information via a local ISP, such as 615 and 620, and the Internet 604, to a remote server such as the database server 124 in the central office 142.

Using the network interface, the gaming machine 636 may send game performance data, game usage information and gaming machine status information or any other information of interest generated on the gaming machine from one or more gaming transactions to the database server 124 located in the central office or some other remote server. Using this method, the need to manually gather data from the gaming machine using a route operator may be eliminated, which may reduce gaming machine operating costs and may provide better tracking of the performance of gaming machines, such as 636, that have traditionally operated in a "stand alone" mode.

For security purposes, any information transmitted from the gaming machine 636 over a public network to a remote server may be encrypted. The encryption may be performed by the master gaming controller or by another logic device located on the gaming machine. In one embodiment, the information from the gaming machine may be symmetrically encrypted using a symmetric encryption key where the symmetric encryption key is asymmetrically encrypted using a private key. The public key may be obtained by the gaming machine 636 from a remote public key server. The encryption algorithm may reside in processor logic stored on the gaming machine. When a remote server receives a message containing the encrypted data, the symmetric encryption key is decrypted with a private key residing on the remote server and the symmetrically encrypted information sent from the gaming machine is decrypted using the symmetric encryption key. In addition, a different symmetric encryption key is used for each transaction where the key is randomly generated. Symmetric encryption and decryption is applied to most of the information because symmetric encryption algorithms tend to be 100-10,000 faster than asymmetric encryption algorithms.

Information needed to apply the encryption algorithm such as private keys and public keys may be stored on a memory residing in the gaming machine 636 where the memory may be a flash memory, an EPROM, a non-volatile memory, a ROM, a RAM, a CD, a DVD, a tape drive, a hard drive or other memory storage device. Typically, the public keys are stored on a writeable media such as a hard drive while the private keys are stored on a read only memory such as an EPROM or a CD-ROM. The same or a different memory residing on the gaming machine 636 may also include information used to authenticate communications between the gaming machine 636 and a remote server, such as 124. For instance, a serial number or some other identification numbers may be used by the firewall 600 or the database server 124 to authenticate the sender of a message.

The encrypted communications from the gaming machine 636 to a remote server may be implemented using a TCP/IP communication protocol. Thus, the encrypted information from the gaming machine may be encapsulated in multiple information packets and sent to the IP address and/or an unique ID (UID) of a remote server. The gaming machine 636 may contain a memory storing a number of IP addresses and/or unique IDs (UIDs) of remote servers or other devices where the gaming machine may send information. Prior to sending a message, the gaming machine may look up the IP address and/or the UID of the remote server or destination device.

For each information packet, the gaming machine may generate one or more signatures and may append them to the information packet. The signature may allow the recipient of the packet to unambiguously identify the sender of the packet as well as to determine if the correct amount of data was received. For instance, the signature may include a checksum of the data that was sent. Further, the information packet may contain routing information allowing subsequent communication with the gaming machine, such as an IP address and/or an UID of the gaming machine. General details of these types of processes, such as TCP/IP implementation and data authentication, are described in the text "Mobile IP Unplugged" by J. Solomon, Prentice Hall and the text "Computer Networks", A. S. Tanenbaum, Prentice Hall. Both of these references are incorporated herein by reference in their entireties and for all purposes.

Using the communication infrastructure and methods described above a gaming machine or other device connected to a remote server may request one or more gaming services from a remote server. For instance, a gaming machine may send a game license request to the remote server 124. A gaming machine may store code to play one or more games controlled by the master gaming controller such as a video slot game, a mechanical slot game, a lottery game, a video poker game, a video black jack game, a video lottery game, and a video pachinko game. Traditionally, installing a new game has involved manually exchanging (e.g., by hand) an EPROM (e.g. a read-only memory) containing the game on the gaming machine. Using the communication infrastructure described above, the gaming machine 636 may request a game license for one or more games stored in the gaming machine from a remote server acting as a game license server such as 124. The game license server may send a game license reply message containing a game license which allows the gaming machine to present the one or more games stored on the gaming machine. These game license requests may be performed prior to each game or the license may allow game play for some finite time period. For instance, the game license may be an annual license, a monthly license, a daily license, a per-use license or a site license. Details of the game license request and reply process between a gaming machine and a remote server are described with reference to FIGS. 6 and 7.

In another example, the gaming machine 636 may send a maintenance request message to a remote server when the gaming machine malfunctions. After receiving the maintenance request message, the remote server may perform one or more remote diagnostics on the gaming machine 636 via one or more diagnostic request messages. The remote diagnostics may include both software and hardware diagnostics. In addition, the remote server may develop service priority list based upon a plurality of maintenance requests received from a group of gaming machines in communication with the remote server. In yet another example, a remote server may obtain software version information or gaming configuration information, from gaming machine 636, by sending a software version request message or a gaming configuration request message to the machine. Information contained in these messages may be used to provide software updates and gaming configuration updates to the gaming machine 636.

In a further example, the gaming machine 636 may generate a digital signature or some other type of unique identification information and may send a digital signature verification request or an identification verification request to a remote server. The verification request may be part of an electronic fund transfer. After receiving authorization from the remote server in an authorization reply, the gaming machine 636 may send a fund transfer request with fund transfer information to the remote server and may receive a fund transfer reply authorizing the gaming transaction.

A remote server may also provide performance reports or other services for the gaming machine 636. For instance, the gaming machine 636 may send a report request message to the remote server 124 requesting a performance report for the gaming machine over some prior time period. After remote server generates the report, it may be sent back to the gaming machine 636 or some other access point for display. For instance, the report may be displayed on a display screen of the gaming machine 636, a computer 616 located in the store 140 or on a portable network access point 134 located outside of the store.

An advantage of the virtual network described above is that it allows gaming services such as data acquisition, game licensing and report generation to be provided a single gaming machine without the use of a dedicated network which are typically expensive. This advantage may potentially increase the utility of a gaming machine while reducing the costs associated with operating and maintaining a machine. In particular, for gaming establishments with a small number of gaming machines operating in a "stand alone" mode, a virtual network may be the only viable way to provide cost effective gaming services via a network. The virtual network is enabled by an encryption scheme which utilizes multiple key encryption and symmetric encryption keys to provide secure communication of sensitive gaming data. For each session, the symmetric encryption keys may be randomly generated or may be rotated by selecting from a pool of keys.

The methods described above may be applied and may be advantageous to any gaming machine in the gaming entity 650. Also, many different embodiments of the methods are possible. For instance, using a wireless network interface, gaming machine 638 in Casino 110 may send game license requests or other requests to the database server via the router 608, the dedicated line 622, router 602 and the firewall 600. As another example, using a wireline network interface, such as a wired Ethernet connection, a wired ATM connection or a wired frame relay connection, gaming machine 640 in casino 122 may send a gaming report request to the database server 100 in casino 110 via the database server 112, the firewall 610, the router 612, the local ISP 620, the internet 604, the local ISP 615, the router 608 and the firewall 606. When a dedicated communication network is used, encryption may be optional over the dedicated network, e.g. if a dedicated network was used between the gaming machine 640 and the database server 112, the gaming machine 640 may not use encryption to send information to the database server 112. However, the database server would apply an encryption scheme such as the one described above before sending out information over a public network. Returning to the example, the database server 100 may serve as a regional report server. After generating a gaming report reply message to the gaming report request message from gaming machine 640, the database server 100 may send a message to the database server 124 in the central office 142 acknowledging that a report was generated.

The virtual network may also allow remote access to gaming information such as gaming performance information at various gaming establishments in the gaming entity from mobile access points. For example, the remote access point 134 may be a portable computer with a wireless modem. Typically, the remote access point 134 will have a high level of security such as special access software. Using the remote access point 134, a user such as a travelling employee of the game entity may access gaming information at casino 110 or casino 122 via the local ISP 614. The access may be routed through the central office 142 or may be routed directly to one of the casinos bypassing the central office. In addition, different access privileges may be accorded to different remote users. For instance, one remote user may be able to access information from any establishment in the gaming entity while another may only be able to access information from a particular establishment.

Figure 7:
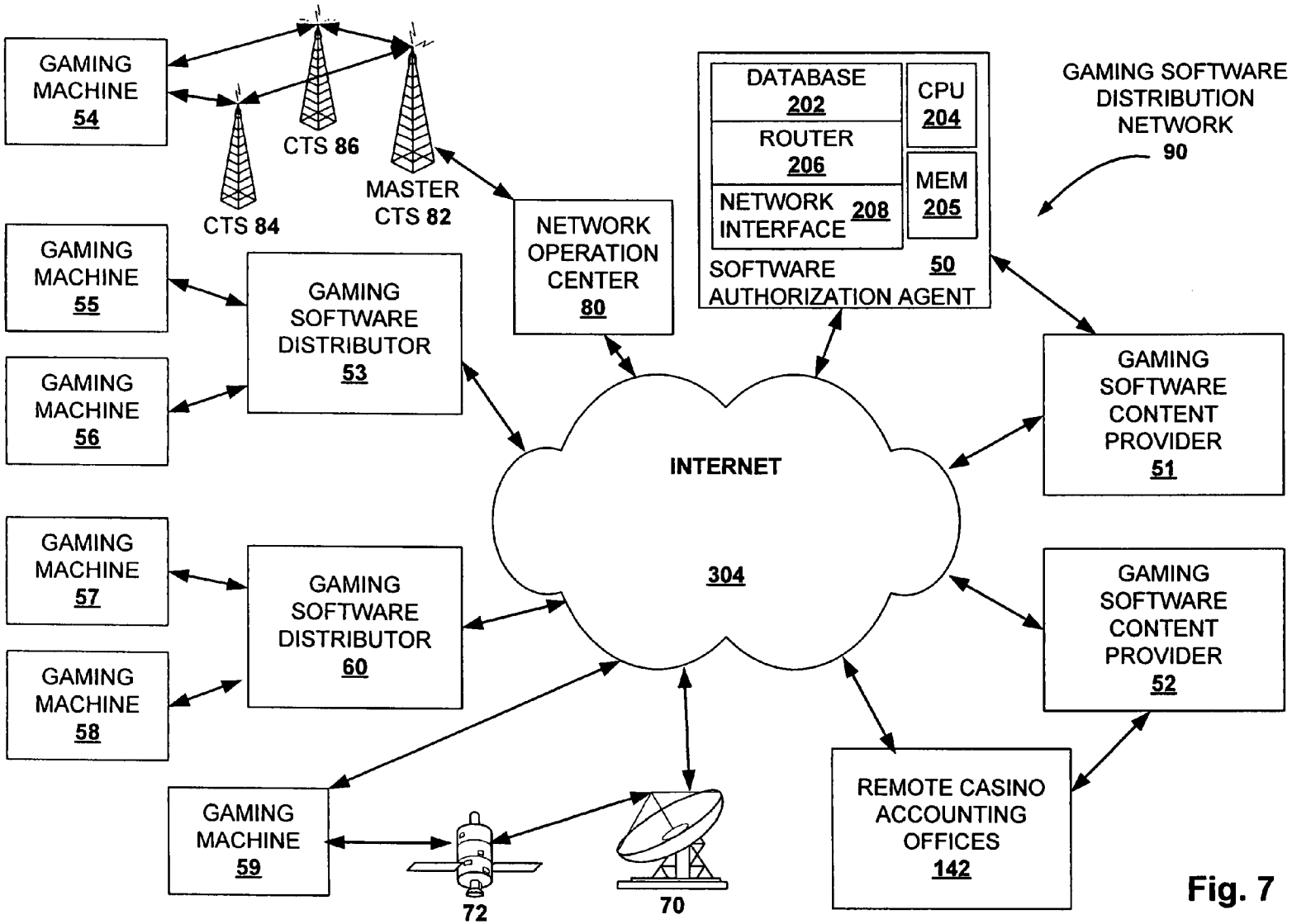
FIG. 7 is a block diagram of a gaming software distribution network.

FIG. 7 is a block diagram of gaming software distribution network that uses a secure virtual network. In the present invention, gaming software may be transferred between various gaming devices, in a gaming software distribution network 90, after receiving authorization from a gaming software authorization agent 50. The gaming software authorization agent 50 may be a conventional data server including but not limited to a database 202, a router 206, a network interface 208, a CPU 204, a memory 205 and a firewall (not shown). The CPU 204 executes software to provide the functions of the authorization agent 50 as will be described below in more detail. In general, the gaming software authorization agent 50 approves all gaming software transactions between two gaming devices in the gaming software distribution network and stores a record of the gaming software transactions. In this example, gaming software authorization agent is located in a different location from content providers, distributors and recipient gaming machines, but in other implementations one or more of these may be located in the same location. Database 202 may be used, for example, to store gaming software transaction records.

In the gaming industry, gaming software that is used to play a game of chance on a gaming machine is typically highly regulated to ensure fair play and prevent cheating. Thus, at any given time, it is important for a gaming regulatory entity to know what gaming software is installed on a gaming machine at any particular time. Currently, gaming software is often programmed into an EEPROM and installed on a gaming machine. When the EEPROM is installed in the gaming machine, it is manually checked by a representative of the gaming regulatory board prior to installation to ensure approved gaming software is being installed on the gaming machine. This process is time consuming and relatively inflexible.

In the gaming industry, there is a desire to simplify the gaming software installation process so that gaming machine operators may more easily reconfigure gaming machines with different gaming software to respond to shifting customer tastes and demands. The gaming software authorization agent 50 meets this need by allowing gaming software to be electronically transferred between gaming devices, such as game servers and gaming machines, in a manner that may be easily monitored and regulated. For instance, the software authorization agent 50 may be maintained or supervised by a gaming regulatory agency. However, the software authorization agent 50 may also be maintained by a gaming entity that controls many gaming properties to track software distributions on various gaming machines. In addition, besides monitoring electronic transfers of gaming software, the software authorization agent 50 may also be used to store a record of any change of gaming software on a gaming machine such as changes resulting from a manual installation of gaming software. For instance, a technician may manually load gaming software on to a gaming machine using a portable memory device storing the gaming software.

Details of gaming devices and the network connections in the gaming software distribution network are now described. In the present invention, gaming software may be transferred between gaming software providers, such as 51 and 52, gaming software distributors, such as 53 and 60, and gaming machines, such as 54, 55, 56, 57, 58 and 59. A gaming software provider may be a gaming device, such as a game server, that is maintained by a gaming software developer, such as IGT (Reno, Nev.), that develops gaming software for various gaming platforms. A gaming software content provider, such as 51 and 52, may maintain a plurality of gaming software titles, versions of gaming software titles and gaming software components that may be requested by another gaming device for an electronic download. The gaming software content provider may download gaming software to various customers after the customer has entered a licensing agreement with the content provider. Some details of obtaining game licenses for operating gaming software on a gaming machine are described in the Game Downloading Applications with respect to FIGS. 6 and 7.

A set of gaming software components may be executed on a gaming machine to play a gaming of chance. The game of chance may include gaming software components used to play a bonus game in conjunction with the game of chance. Thus, a complete set of gaming software components used to play a game of chance may be downloaded or a portion of the gaming software components needed to play a game the game of chance may be downloaded. For instance, a complete package of gaming software components may be downloaded to replace a game executed on a gaming machine with a new game.

As another example, a single game software component may be downloaded to fix an error in a game of chance executed on the gaming machine. In yet another example, a set of gaming software components may be downloaded to install a new graphical "feel" for the game of chance while other gaming software components for the game are not changed. In the present invention, any gaming device that stores gaming software for downloads may download a complete set of the gaming software components used to play the game of chance or portions of a complete set of the gaming software components. Some examples of gaming software components may include but are not limited to: 1) banking modules for coin-in, coin-out, credits cards, fund transfers, 2) security modules for tracking security events such as door open, lost power, lost communication, 3) bet modules for handling betting configurations such as a number of paylines, a number of coins per line and denominations, 4) communication modules allowing a gaming device to communicate with other gaming devices using different communication protocols and 5) an operating system modules used in an operating system installed on the gaming machine. Details of some of the gaming software components that may be downloaded in the present invention are described in co-pending U.S. application Ser. No. 10/040,239, by LeMay et al., filed on Jan. 3, 2002 and titled "Game Development Architecture That Decouples The Game Logic From The Graphics Logic," which is incorporated herein in its entirety and for all purposes.

Gaming software related to other aspects of game play and operation of a gaming machine may also be authorized and downloaded using the methods and hardware of the present invention. For instance, device drivers used to operate a particular gaming device may be downloaded from a content provider or another gaming device. As another example, gaming software used to provide player tracking services and accounting services may be downloaded from a content provider or another gaming device. Even when the gaming software is not regulated by a gaming entity, it may be useful to perform the authorization process because the transaction records may be used to track the distribution of the gaming software on various gaming devices. The transaction records may be helpful to both providers of gaming software and operators of gaming devices in determining necessary upgrades and maintenance of gaming software on a gaming device such as a gaming machine.

A gaming software distributor, such as 53 and 60, may maintain a plurality of gaming software titles, versions of gaming software titles and gaming software components that may be transferred to another gaming device, such as a gaming device, for an electronic download. The gaming software distributors, such as 53 and 60, may be gaming devices, such as game servers, that are maintained by a gaming entity such as a casino. For instance, game server 53 may be operated by a first casino and game server 60 may be operated by a second casino. The game servers may store gaming software that has been licensed to the gaming entity from one or more gaming software providers such as 51 and 52. In one embodiment, a game server may also be a gaming machine. One example of a game server that may be used with the present invention is described in co-pending U.S. patent application Ser. No. 09/042,192, filed on Jun. 16, 2000, entitled "Using a Gaming Machine as a Server" which is incorporated herein in its entirety and for all purposes.

The game servers operated by a gaming entity may be used to provide gaming software to a plurality of gaming machines. For instance, game server 53 may be used to provide gaming software to gaming machine 54, 55, 56 and game server 60 may be used to provide gaming software to gaming machines 57, 58 and 59. In one embodiment, the game servers may be programmed to download gaming software in response to a software request on a gaming machine. For instance, a game player playing a game on a gaming machine, such as 55, may request to play a particular game of chance on the gaming machine 55, which is downloaded to the gaming machine from the game server 53. In another embodiment, the game servers, such as 53 and 60, may be used to update and reconfigure the gaming software on one or more gaming machines. For instance, the game server 53, may be used to regularly change the games of chance or bonus games of chance available for play on gaming machines 54, 55 and 56.

In the present invention, gaming software transferred between two gaming devices and communications between two gaming devices may use a variety of network architectures including but not limited to local area networks, wide area networks, private networks, a virtual private network, the Internet 304 and combinations thereof. Details of methods of using the Internet 304 in a secure manner are described in the Game Download Applications with respect to FIGS. 3, 4, 5A and 5B.

In one embodiment, gaming software and other gaming information may be transferred between two gaming devices using a satellite connection. For instance, the gaming information transferred via satellite may include but is not limited to metering information generated on the gaming machine. In a gaming device using a satellite communication system, the gaming device is connected to a satellite dish. For instance, a gaming machine located in a store or a cruise ship may use a satellite connection. Two standard coaxial cables may connect the gaming device to the satellite dish. The gaming device, such as a gaming machine, may include a satellite modem to enable the satellite connection.

The satellite dish may send requests to the Internet 304 and receive Internet content via the satellite 72. The satellite 72, in turn, may communicate with a hub facility 70, which has a direct connection with the Internet 304. Typically, the transfer rate of information from the gaming device, such as gaming machine 59, to the satellite 72 (uplink rate) is less than the transfer of rate of information from the satellite 72 to the gaming device (downlink rate). For example, the uplink rate may be 28 Kilobytes per second while the downlink rate may be 500 kilobytes per second or higher. However, for software downloads, a high downlink rate may only be required for efficient gaming software downloads. Satellite Internet services may be provided by a company such as Starband Corporation (Mclean, Va.).

In another embodiment, gaming software and other gaming information may be transferred between two gaming devices using an RF connection. The gaming information transferred via the RF connection may include but is not limited metering information generated on the gaming machine. As one example, U.S. Telemetry corporation (UTSC, Dallas, Tex.), uses radio frequency transmissions in the 218-222 MHz band to provide communications services to fixed end point devices as well as mobile devices. The fixed end point device may be a gaming machine located in a store or located in a casino, such as gaming machine 54, as well as a mobile gaming device such as a gaming machine located in a riverboat or portable gaming device that may be carried by a player and used to play a game of chance.

The RF network in a metropolitan service area may include cell transceiver sites or towers, such as 84 and 86, a system hub or master cell transceiver site, such as 82. The MCTS 82 is connected to a Network Operations Center (NOC) 80, which is essentially a data clearinghouse. Data is transferred from a CTS, such as 84 and 86, to a Master CTS (MCTS) 82 through a Publicly Switched Telephone Network. Data is transferred from the MCTS 82 to the NOC 80 database via an ATM or a Frame Relay. Data transfer protocol and user access to various end-point devices may be provided through web interfaces. Thus, using an RF network and the secured virtual network methods as described elsewhere, gaming information as well as gaming software may be transferred between various gaming devices. For instance, a remote casino accounting office 142 may obtain information from gaming devices connected to the RF network via the Internet 304.

Records of authorizations for the transfer of gaming software between gaming devices may be stored in the database 202. Thus, given an initial distribution of gaming software in the gaming software distribution network 90 for each gaming device, the gaming software authorization records may be used to track the gaming software distribution for gaming devices in the gaming distribution network as a function of time. This tracking capability may be useful for various gaming entities such as a gaming regulatory board, a gaming software content provider and gaming operators. For instance, a gaming regulatory board may be able to see the gaming software installed on all gaming devices it regulates at any given time using the database 202. As another example, a gaming software content provider, such as 51 and 52, may be able to view gaming software requests for their gaming software products as a function of time. In yet another example, a remote casino accounting office 142 may be view the distribution of its gaming software on the gaming machine under its control.

The database 202 may be partitioned and include various security protocols to limit access of the data in transaction database according to various criteria. For instance, a gaming software provider 51 may be able to view records only of gaming software transactions involving their products but not of a competitors products. As another example, a gaming entity may be able to view records of gaming software transactions involving gaming machine that they operate but not view gaming software transactions for gaming machines that another competitor controls.

Figure 8:
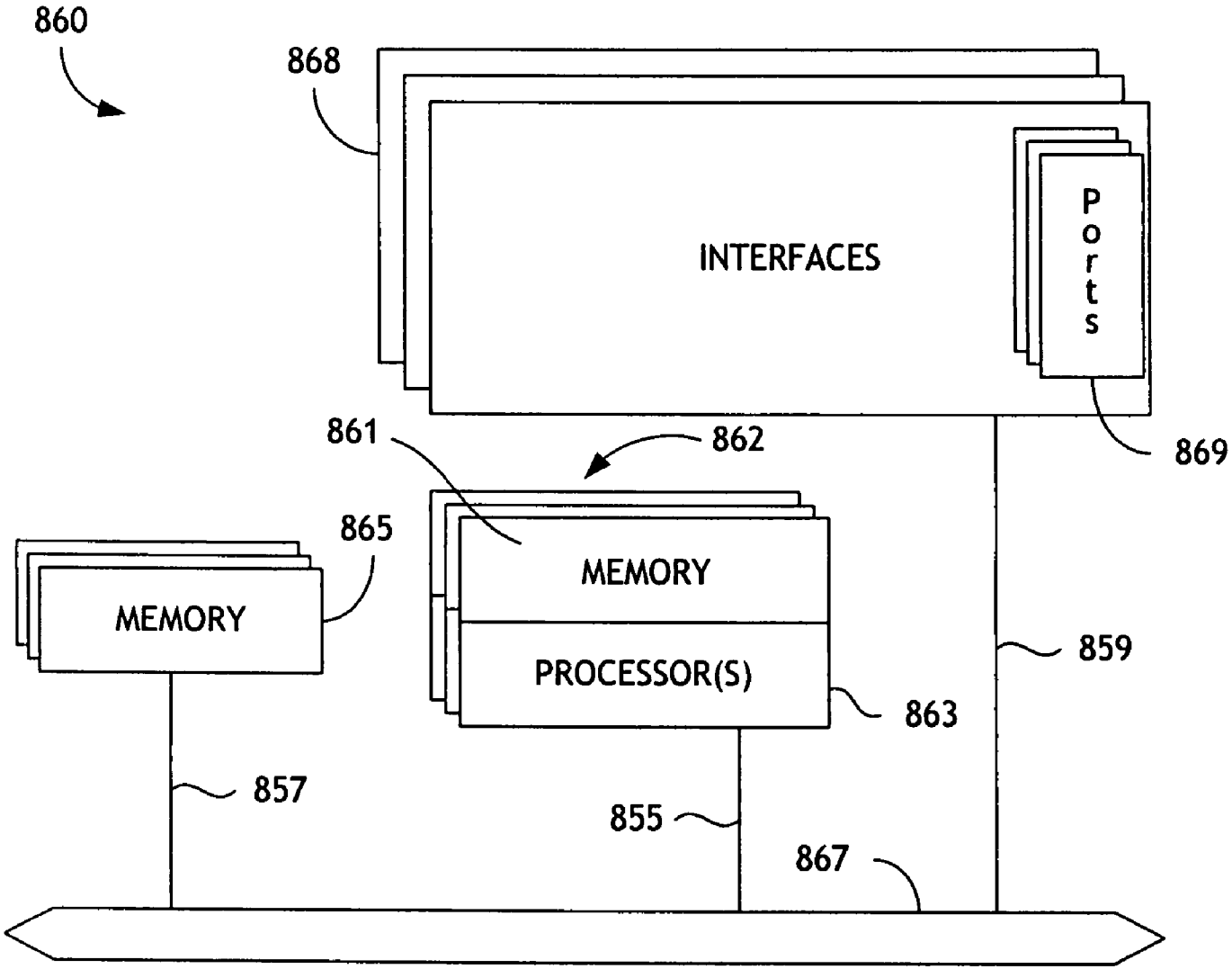
FIG. 8 is a network device that may be configured according to some implementations of the present invention.

FIG. 8 illustrates an example of a network device that may be configured to implement some methods of the present invention. Network device 860 includes a master central processing unit (CPU) 862, interfaces 868, and a bus 867 (e.g., a PCI bus). Generally, interfaces 868 include ports 869 appropriate for communication with the appropriate media. In some embodiments, one or more of interfaces 868 includes at least one independent processor and, in some instances, volatile RAM. The independent processors may be, for example ASICs or any other appropriate processors. According to some such embodiments, these independent processors perform at least some of the functions of the logic described herein. In some embodiments, one or more of interfaces 868 control such communications-intensive tasks as media control and management. By providing separate processors for the communications-intensive tasks, interfaces 868 allow the master microprocessor 862 efficiently to perform other functions such as routing computations, network diagnostics, security functions, etc.

The interfaces 868 are typically provided as interface cards (sometimes referred to as "linecards"). Generally, interfaces 868 control the sending and receiving of data packets over the network and sometimes support other peripherals used with the network device 860. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 862 may be responsible for implementing specific functions associated with the functions of a desired network device. According to some embodiments, CPU 862 accomplishes all these functions under the control of software including an operating system and any appropriate applications software.

CPU 862 may include one or more processors 863 such as a processor from the Motorola family of microprocessors or the MIPS family of microprocessors. In an alternative embodiment, processor 863 is a specially designed hardware for controlling the operations of network device 860. In a specific embodiment, a memory 861 (such as non-volatile RAM and/or ROM) also forms part of CPU 862. However, there are many different ways in which memory could be coupled to the system. Memory block 861 may be used for a variety of purposes such as, for example, caching and/or storing data, programming instructions, etc.

Regardless of network device's configuration, it may employ one or more memories or memory modules (such as, for example, memory block 865) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc., for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher level code that may be executed by the computer using an interpreter.

Although the system shown in FIG. 8 illustrates one specific network device of the present invention, it is by no means the only network device architecture on which the present invention can be implemented. For example, an architecture having a single processor that handles communications as well as routing computations, etc., is often used. Further, other types of interfaces and media could also be used with the network device. The communication path between interfaces may be bus based (as shown in FIG. 8) or switch fabric based (such as a cross-bar).

The above-described devices and materials will be familiar to those of skill in the computer hardware and software arts. Although many of the components and processes are described above in the singular for convenience, it will be appreciated by one of skill in the art that multiple components and repeated processes can also be used to practice the techniques of the present invention. Conversely, the steps in some processes and/or components in some embodiments may be combined within the scope of the present invention. For example, some steps described herein as being performed by a game server or by a gaming machine could be performed by one or more other networked devices.

FIGS. 16-20 and the corresponding description of application Ser. No. 11/078,966, entitled "SECURED VIRTUAL NETWORK IN A GAMING ENVIRONMENT", filed Mar. 10, 2005, and now issued as U.S. Pat. No. 7,515,718 describe embodiments of a system for providing downloads of game software, game licensing services and game software tracking/auditing software. These figures and description, which have been incorporated herein for all purposes, describe some implementations that may be used in accordance with the present invention.

Although the foregoing invention has been described in some detail for purposes of clarity of understanding, it will be apparent that certain changes and modifications may be practiced within the scope of the appended claims. For example, some methods of the invention involve downloading games according to recent popularity and/or demand for the game, even when there has been no specific request to download the software for the game. In some such implementations, game downloads can be based upon a list, table, etc, that indicates the popularity of wagering games. The list could be based, for example, on local, regional, national or global usage of a particular game. The list could apply to a predetermined time period and could be updated at certain times or as data become available.

We claim:

1. A method of downloading gaming software, the method comprising:

transmitting, by a server, a set of gaming software blocks on a channel, wherein each gaming software block in the set of gaming software blocks includes gaming software for a corresponding wagering game in a plurality of wagering games, wherein said transmitting the set of gaming software blocks comprises repeatedly transmitting the set of gaming software blocks one or more times in a continuous manner, wherein said transmitting is performed independent of whether a request for the transmission is received by the server, and wherein the wagering games in the plurality of wagering games share one or more common game characteristics;

determining, by a gaming machine, that desired gaming software for a first wagering game in the plurality of wagering games is available on the channel based on the one or more common game characteristics corresponding with game characteristics of the desired wagering game, wherein the desired gaming software is included in a first gaming software block in the set of gaming software blocks, and wherein the first gaming software block is bounded by a first frame and a last frame;

selecting, by the gaming machine, the channel; and beginning, by the gaming machine, a download of the desired gaming software from the selected channel at an arbitrary frame within the first gaming software block during a first transmission of the first block during the transmitting; and completing, by the gaming machine, the download of the desired gaming software from the selected channel at a second frame within the first gaming software block during a subsequent repeat transmission of the first gaming software block during the transmitting, wherein the arbitrary frame and the second frame are not the first and last frames, respectively, and wherein the portion of the first gaming software block between the arbitrary frame and the last frame, inclusive of the arbitrary frame and the last frame, and the portion of the first gaming software block between the first frame and the second frame, inclusive of the first frame and the second frame, include all frames comprising the first gaming software block.

2. The method of claim 1, wherein the desired gaming software is a whole desired wagering game.

3. The method of claim 1, wherein the desired gaming software is a desired software component for the first wagering game.

4. The method of claim 1, further comprising the step of authenticating a requestor of the desired gaming software.

5. The method of claim 1, further comprising the step of determining whether a license is available for the desired gaming software.

6. The method of claim 1, further comprising the step of determining whether it is legal to use the desired gaming software in a jurisdiction where the desired gaming software will be received.

7. The method of claim 1, wherein the selected channel is one of an electromagnetic frequency range, a separate physical link, a separate virtual link or a component of a multiplexed data stream.

8. The method of claim 1, further comprising the step of authorizing a payment for the desired gaming software.

9. The method of claim 2, further comprising the step of detecting the desired gaming software in the transmission of the set of gaming software blocks, wherein the gaming software for one or more wagering games in the plurality of wagering games represents software for the whole wagering game.

10. The method of claim 3, further comprising the step of detecting the desired gaming software in the transmission of the set of gaming software blocks, wherein the gaming software for one or more wagering games in the plurality of wagering games represents one or more software components for the one or more wagering games.

11. The method of claim 1, wherein said transmitting comprises repeating the transmission of the set of gaming software blocks without reference to whether an acknowledgement of receipt has been received for any of the transmissions.

12. The method of claim 1, wherein said transmitting the set of gaming software blocks comprises repeating the transmissions of the gaming software without any interruption between the repeat transmissions.

13. The method of claim 1, wherein said transmitting the set of gaming software blocks comprises transmitting the gaming software block for a particular wagering game in the plurality of wagering games more than twice in succession.

14. The method of claim 1, wherein said transmitting the set of gaming software blocks comprises repeating a transmission of a particular gaming software block immediately subsequent to a previous transmission of the particular gaming software block.

15. A method of downloading gaming software in a network of gaming machines, comprising:

detecting, by a gaming machine, desired gaming software related to a first wagering game in a transmission on a channel of a gaming network, wherein the transmission is performed by a server independent of whether a request for the transmission from the gaming machine is received by the server, wherein the transmission comprises repeatedly transmitting a gaming software block including the desired gaming software one or more times in a continuous manner, and wherein the gaming software block is bounded by a first frame and a last frame;

beginning, by the gaming machine, a download of the desired gaming software at an arbitrary frame within the gaming software block during a first transmission of the gaming software block in the transmission; and completing, by the gaming machine, the download of the desired gaming software at a second frame within the gaming software block during a subsequent repeat transmission of the gaming software block in the transmission, wherein the arbitrary frame and the second frame are not the first and last frames, and wherein the portion of the gaming software block between the arbitrary frame and the last frame, inclusive of the arbitrary frame and the last frame, and the portion of the gaming software block between the first frame and the second frame, inclusive of the first frame and the second frame, include all frames comprising the gaming software block.

16. The method of claim 15, wherein the desired gaming software comprises all components of the first wagering game.

17. The method of claim 15, wherein the desired gaming software consists of a software component for the first wagering game.

18. The method of claim 15, wherein the channel is one of an electromagnetic frequency range, a separate physical link, a separate virtual link or a component of a multiplexed data stream.

19. A gaming machine for playing wagering games of chance, the gaming machine comprising:

a gaming controller; and a communications interface, wherein the communications interface is configured to access a channel over which a transmission of gaming software for a plurality of wagering games is broadcast, wherein the transmission is performed by a server independent of whether a request for the transmission from the gaming machine is received by the server, wherein the wagering games in the plurality of wagering games share one or more common game characteristics, wherein the transmission comprises a set of gaming software blocks, wherein each gaming software block in the set of gaming software blocks corresponds with a corresponding wagering game in the one or more wagering games, and wherein the transmission includes one or more continuous repeats of the set of gaming software blocks, wherein the gaming controller is configured to:

determine that desired wagering game software for a first wagering game in the plurality of wagering games is available on the channel based on the one or more common game characteristics corresponding with game characteristics of the desired wagering game, wherein the desired gaming software is included in a first gaming software block in the set of gaming software blocks, and wherein the first gaming software block is bounded by a first frame and a last frame, select the channel, begin a download of the desired gaming software from the selected channel at an arbitrary frame within the first gaming software block during a first transmission of the first block during the transmission; and complete the download of the desired gaming software from the selected channel at a second frame within the first gaming software block during a subsequent repeat transmission of the first gaming software block during the transmission, wherein the arbitrary frame and the second frame are not the first and last frames, respectively, and wherein the portion of the first gaming software block between the arbitrary frame and the last frame, inclusive of the arbitrary frame and the last frame, and the portion of the first gaming software block between the first frame and the second frame, inclusive of the first frame and the second frame, include all frames comprising the first gaming software block, accept a wager for an instance of the first wagering game generated at least in part by executing the desired wagering game software, and present the instance of the first wagering game.

20. A gaming machine for playing wagering games of chance, the gaming machine comprising:

a gaming controller; and a communications interface, wherein the communications interface is configured to access a channel of a gaming network over which a transmission of desired gaming software for a first wagering game is broadcast, wherein the transmission is performed by a server independent of whether a request for the transmission from the gaming machine is received by the server, wherein the transmission comprises repeatedly transmitting a gaming software block including the desired gaming software one or more times in a continuous manner, and wherein the gaming software block is bounded by a first frame and a last frame, wherein the gaming controller is configured to:

detect the desired wagering game software on the channel;

begin a download of the desired wagering game software at an arbitrary frame within the gaming software block during a first transmission of the gaming software block in the transmission complete the download of the desired wagering game software at a second frame, wherein the arbitrary frame and the second frame are not the first and last frames, and wherein the portion of the gaming software block between the arbitrary frame and the last frame, inclusive of the arbitrary frame and the last frame, and the portion of the gaming software block between the first frame and the second frame, inclusive of the first frame and the second frame, include all frames comprising the gaming software block, accept a wager for an instance of the first wagering game generated at least in part by executing the desired wagering game software, and present the instance of the first wagering game.

21. A gaming network, comprising:

at least one server configured to provide a transmission of wagering game software for a first wagering game on a channel of the gaming network, wherein the at least one server is configured to provide the transmission independent of whether the at least one server receives a request to download the wagering game software to a first gaming machine from the first gaming machine, wherein the transmission comprises repeated transmissions of a gaming software block including the wagering gaming software one or more times in a continuous manner, and wherein the gaming software block is bounded by a first frame and a last frame; and a plurality of gaming machines, the plurality of gaming machines including the first gaming machine, configured to offer a plurality of wagering games, each of the plurality of gaming machines further configured for communication with the at least one server via the gaming network, and each of the plurality of gaming machines comprising:

a communications interface configured to communicate with the gaming network; and a gaming controller, the gaming controller configured to:

detect the desired wagering game software on the channel;

begin a download of the wagering game software at an arbitrary frame within the gaming software block during a first transmission of the gaming software block in the transmission;

complete the download of the wagering game software at a second frame, wherein the arbitrary frame and the second frame are not the first and last frames of the desired software, and wherein the portion of the gaming software block between the arbitrary frame and the last frame, inclusive of the arbitrary frame and the last frame, and the portion of the gaming software block between the first frame and the second frame, inclusive of the first frame and the second frame, include all frames comprising the gaming software block;

accept a wager for an instance of the first wagering game generated at least in part by executing the wagering game software; and present the instance of the first wagering game.

22. The gaming network of claim 21, wherein the wagering game software is a whole desired wagering game.

23. The gaming network of claim 21, wherein the wagering game software is a desired software component for the first wagering game.

24. A method of downloading gaming software, the method comprising:

transmitting, by a server, a plurality of gaming software blocks on a channel, each gaming software block corresponding to a wagering game in a plurality of wagering games, wherein the gaming software blocks in the plurality of gaming software blocks are transmitted in a predetermined sequence, wherein the transmitting comprises repeating the transmission of the plurality of gaming software blocks one or more times in a continuous manner, and wherein said transmitting is performed independent of whether a request for download of a wagering game in the plurality of wagering games is received from a gaming machine by the server;

determining, by the gaming machine, that the plurality of gaming software blocks includes a first gaming software block corresponding to a desired wagering game in the plurality of wagering games;

determining, by the gaming machine, the identity of the first gaming software block based on the position of the first gaming software block in the sequence relative to the other gaming software blocks in the plurality of gaming software blocks;

selecting, by the gaming machine, the channel; and beginning, by the gaming machine, a download of the desired gaming software from the selected channel at an arbitrary frame within the first gaming software block during a first transmission of the first block during the transmitting;

completing, by the gaming machine, the download of the desired gaming software from the selected channel at a second frame within the first gaming software block during a subsequent repeat transmission of the first gaming software block during the transmitting, wherein the arbitrary frame and the second frame are not the first and last frames, respectively, and wherein the portion of the first gaming software block between the arbitrary frame and the last frame, inclusive of the arbitrary frame and the last frame, and the portion of the first gaming software block between the first frame and the second frame, inclusive of the first frame and the second frame, include all frames comprising the first gaming software block.

* * * * *

UNITED STATES PATENT AND TRADEMARK OFFICE

CERTIFICATE OF CORRECTION

PATENT NO. : 7,972,214 B2
APPLICATION NO. : 11/173442
DATED : July 5, 2011
INVENTOR(S) : Michael Kinsley et al.

It is certified that error appears in the above-identified patent and that said Letters Patent is hereby corrected as shown below:

On the Title page, delete "Related U.S. Application Data (63) Continuation-in-part of application No. 11/078,966, filed on Mar. 10, 2005, now Pat. No. 7,515,718, and a continuation-in-part of application No. 10/116,424, filed on Apr. 3, 2002, now Pat. No. 7,168,089, and a continuation-in-part of application No. 09/732,650, filed on Dec. 7, 2000, now Pat. No. 7,127,069.".

In line 24 of claim 1 (column 27, line 42), delete "and".

In line 34 of claim 19 (column 29, line 49), change "; and" to be --,--.

In line 17 of claim 20 (column 30, line 17), change "the channel;" to be --the channel,--.

In line 21 of claim 20 (column 30, line 21), change "in the transmission" to be --in the transmission,--.

In line 24 of claim 24 (column 32, line 12), delete "and".

In line 29 of claim 24 (column 32, line 17), change "transmitting;" to be --transmitting; and--.

Signed and Sealed this
Eleventh Day of December, 2012

David J. Kappos

David J. Kappos
*Director of the United States Patent and Trademark Office*